US012458158B2

(12) United States Patent
Johnson et al.

(10) Patent No.: US 12,458,158 B2
(45) Date of Patent: Nov. 4, 2025

(54) HAMMOCK SLEEPING BAG

(71) Applicant: Kell Outfitters, LLC., Eastvale, CA (US)

(72) Inventors: Spencer Johnson, Eastvale, CA (US); Jacob Martin, Eastvale, CA (US)

(73) Assignee: Kell Outfitters, LLC., Eastvale, CA (US)

( * ) Notice: Subject to any disclaimer, the term of this patent is extended or adjusted under 35 U.S.C. 154(b) by 89 days.

(21) Appl. No.: 18/620,913

(22) Filed: Mar. 28, 2024

(65) Prior Publication Data

US 2025/0057340 A1 Feb. 20, 2025

Related U.S. Application Data

(60) Provisional application No. 63/455,203, filed on Mar. 28, 2023.

(51) Int. Cl.
*A47G 9/08* (2006.01)
*A45F 3/22* (2006.01)
(Continued)

(52) U.S. Cl.
CPC ..... *A47G 9/086* (2013.01); *A45F 3/22* (2013.01); *E04H 15/10* (2013.01); *A45F 2003/003* (2013.01)

(58) Field of Classification Search
CPC ..... A45F 3/22; A45F 3/24; A45F 3/26; A45F 3/52; A47C 17/84; A47G 9/08; A45G 9/083; A45G 9/086
See application file for complete search history.

(56) References Cited

U.S. PATENT DOCUMENTS 1,071,764 A 9/1913 Lowrimore
2,321,966 A 6/1943 Anderson
(Continued)

OTHER PUBLICATIONS

7 Best Sleeping Bags for Hammocks—That Hammock Life, https://thathammocklife.com/sleeping-bags-for-hammocks/, Jan. 19, 2023, 26 pages.

(Continued)

*Primary Examiner* — Fredrick C Conley
(74) *Attorney, Agent, or Firm* — LAPPLE UBELL IP LAW, LLP.; Matthew C. Lapple

(57) ABSTRACT

A hammock sleeping bag having a hammock support sheet with a head end, a foot end, a first edge, a second edge, and a transverse mid-point line from the first edge to the second edge at the approximate mid-point between the head end and the foot end, with a head hang strap affixed to the head end and a foot hang strap affixed to the foot end, where the head hang strap and the foot hang strap are configured to enable the hammock support sheet to be suspended between two points, with a top quilt affixed to the first edge, a bottom quilt affixed to the second edge, and where the hammock support sheet, the top quilt, and the bottom quilt are integral to the hammock sleeping bag, with a first closeable zipper enabling a removable closure of the top quilt to the second edge of the support sheet, with a second closeable zipper enabling a removable closure of the bottom quilt to the first edge of the support sheet, where the hammock support sheet has a first measured area and the bottom quilt has a second measured area, and where the bottom quilt has a centerline running from the head end to the foot end, were the second measured area is larger than the second measured area, so that when the hammock support sheet is suspended between two points, and the second closeable zipper is closed, the bottom quilt centerline does not contact the hammock support sheet at the transverse mid-point line, thereby creating
(Continued)

an air gap between the hammock support sheet and the bottom quilt, so that when the hammock sleeping bag is in use, the bottom quilt along the centerline is not load-bearing at the air gap.

24 Claims, 22 Drawing Sheets

(51) Int. Cl.
*E04H 15/10* (2006.01)
*A45F 3/00* (2006.01)

(56) References Cited

U.S. PATENT DOCUMENTS

| | | | | |
|---|---|---|---|---|
| 2,375,792 | A | 5/1945 | Kearny | |
| 2,971,205 | A | 2/1961 | Shultz | |
| 3,675,256 | A * | 7/1972 | Tallarico | A45F 3/22 5/120 |
| 3,964,113 | A | 6/1976 | Dean, II | |
| 4,001,902 | A | 1/1977 | Hall et al. | |
| 4,021,868 | A | 5/1977 | Fueslein | |
| 4,071,917 | A | 2/1978 | Mojica | |
| 5,072,465 | A | 12/1991 | Lyons, Jr. | |
| 7,178,182 | B2 | 2/2007 | Brenner et al. | |
| 8,893,328 | B1 | 11/2014 | Kroeger | |
| 9,359,786 | B1 | 6/2016 | Fenton | |
| D851,360 | S | 6/2019 | Whittaker et al. | |
| D858,036 | S | 9/2019 | Brady et al. | |
| 11,492,820 | B2 | 11/2022 | Taylor | |
| 2009/0165205 | A1 | 7/2009 | Hennessy | |
| 2013/0146633 | A1 | 6/2013 | Sesoko | |
| 2014/0196209 | A1 | 7/2014 | Macaskill | |
| 2014/0216511 | A1 | 8/2014 | Brown et al. | |
| 2014/0299638 | A1 | 10/2014 | Hutchins | |
| 2014/0304911 | A1 | 10/2014 | Kramer | |
| 2014/0345049 | A1 | 11/2014 | Gash | |
| 2016/0338477 | A1 | 11/2016 | Browning | |
| 2017/0202344 | A1 | 7/2017 | Ressier | |
| 2017/0332769 | A1 | 11/2017 | Stinnett | |
| 2018/0064234 | A1 | 3/2018 | Graff | |
| 2018/0213952 | A1 | 8/2018 | Penn et al. | |
| 2018/0289134 | A1 | 10/2018 | Hoopes et al. | |
| 2018/0303229 | A1 * | 10/2018 | Lystrup | A45F 3/24 |
| 2018/0352940 | A1 * | 12/2018 | Kaltreider | A47C 21/048 |
| 2019/0231055 | A1 | 8/2019 | Seidel | |
| 2019/0239626 | A1 | 8/2019 | Uyesugi | |
| 2019/0338551 | A1 | 11/2019 | Wiseman | |
| 2020/0121064 | A1 | 4/2020 | TenBrink | |

OTHER PUBLICATIONS

Antero 0°F Hammock Compatible 800FP Goose Down Sleeping Bag-Hyke & Byke USA, https://www/hykeandbyke.com/collections/hammock-compatible-down-sleeping-bags/products . . . , Jan. 19, 2023, 6 pages.

Grand Trunk Under New Ownership, SGB Media Online, https://sgbonline.com/grand-trunk-under-new-ownership, Jun. 30, 2020, 4 pages.

* cited by examiner

HAMMOCK SLEEPING BAG

FIELD OF THE DISCLOSURE

Embodiments disclosed in the present application relate to improvements in sleeping bags.

SUMMARY

Embodiments disclosed herein relate to improvements in sleeping bags. In particular, embodiments disclosed herein relate to improved hammock-style sleeping bags. In further particularity, embodiments herein relate to improved structures and configurations for adjusting and changing blanketing in a integrated hammock sleeping bag, to enable a user to maintain optimum temperature and comfort, while reducing weight and complexity of a user's sleeping kit.

In a first embodiment, a hammock sleeping bag has a hammock support sheet having a head end, a foot end, a first edge, a second edge, and a transverse mid-point line from the first edge to the second edge at the approximate mid-point between the head end and the foot end, with a head hang strap affixed to the head end and a foot hang strap affixed to the foot end, where the head hang strap and the foot hang strap are configured to enable the hammock support sheet to be suspended between two points, with a top quilt affixed to the first edge, a bottom quilt affixed to the second edge, and where the hammock support sheet, the top quilt, and the bottom quilt are integral to the hammock sleeping bag, with a first closeable zipper enabling a removable closure of the top quilt to the second edge of the support sheet, with a second closeable zipper enabling a removable closure of the bottom quilt to the first edge of the support sheet, where the hammock support sheet has a first measured area and the bottom quilt has a second measured area, and where the bottom quilt has a centerline running from the head end to the foot end, were the second measured area is larger than the second measured area, so that when the hammock support sheet is suspended between two points, and the second closeable zipper is closed, the bottom quilt centerline does not contact the hammock support sheet at the transverse mid-point line, thereby creating an air gap between the hammock support sheet and the bottom quilt, so that when the hammock sleeping bag is in use, the bottom quilt along the centerline is not load-bearing at the air gap.

In an embodiment of the first aspect, the hammock sleeping bag also has a first support strap extending from the head end to the foot end, where the first support strap is affixed to the first edge of the hammock support sheet, where the first support strap is affixed to the head hang strap at the head end, and the first support strap is affixed to the foot hang strap at the foot end, with a second support strap extending from the head end to the foot end, where the second support strap is affixed to the second edge of the hammock support sheet and the second support strap is affixed to the head hang strap at the head end and where the second support strap is affixed to the foot hang strap at the foot end.

In another embodiment of the first aspect, the hammock support sheet and the bottom quilt are configured such that the second area is sufficiently greater than the first area, such that the bottom quilt along the majority of the centerline is not load-bearing.

In another embodiment of the first aspect, has the hammock support sheet and the bottom quilt are configured such that the second area is sufficiently greater than the first area, such that the bottom quilt along the entire centerline is not load-bearing.

In another embodiment of the first aspect, the hammock sleeping bag has the air gap of at least 5 cm.

In another embodiment of the first aspect, the hammock sleeping bag has the air gap of between 5 cm and 10 cm.

In another embodiment of the first aspect, the hammock sleeping bag has the bottom quilt made from a first section and a second section, and the first section and the second section are affixed by a center seam positioned generally along the centerline.

In another embodiment of the first aspect, the hammock sleeping bag has the bottom quilt made of a box baffle quilt.

In another embodiment of the first aspect, the hammock sleeping bag has a first top quilt rollup closure affixed to the first edge where the top quilt may be unzipped from the second edge and rolled toward the first edge and the first top quilt rollup closure is configured to secure the rolled top quilt generally to the first edge.

In another embodiment of the first aspect, the hammock sleeping bag has a second top quilt rollup closure affixed to the first edge where the top quilt may be unzipped from the second edge and rolled toward the first edge and the second top quilt rollup closure is configured to secure the rolled top quilt generally to the first edge.

In another embodiment of the first aspect, the hammock sleeping bag has a first bottom quilt rollup closure strap affixed to the second edge, where the bottom quilt may be unzipped from the first edge and rolled toward the second edge and the first bottom quilt rollup closure is configured to secure the rolled bottom quilt generally to the second edge.

In another embodiment of the first aspect, the hammock sleeping bag of has a second bottom quilt rollup closure affixed to the second edge, where the bottom quilt may be unzipped from the first edge and rolled toward the second edge and the second bottom quilt rollup closure is configured to secure the rolled bottom quilt generally to the second edge.

In another embodiment of the first aspect, the hammock sleeping bag has a top quilt zipper pull cord attached to a first zipper pull tab of a first zipper slider, of the first closeable zipper, with a top quilt zipper pull cord attachment point located proximal to a top stop of the first closeable zipper, and where the top quilt zipper pull cord is attached to the top quilt zipper pull cord attachment point, where the top quilt zipper pull cord is of a sufficient length to enable the first zipper slider to run the entire length of the first closeable zipper, so that a user in the hammock sleeping bag may use the top quilt zipper pull cord to pull the first zipper slider the entire length of the first closeable zipper so as to close the first closeable zipper without touching the first zipper pull tab.

In another embodiment of the first aspect, the top quilt also includes a top quilt face overlap, proximal to the head end, where the top quilt face overlap is an overlap of the top quilt at the approximate position of the face of a user when in use, so that the top quilt face overlap may be folded into an open position to allow for the user's face to be exposed when in use, or the top quilt face overlap may be flipped up into a closed position to cover the user's face when in use, and where the top quilt face overlap includes at least one plastic snap to removably secure the top quilt face overlap into the closed position.

In another embodiment of the first aspect, the hammock sleeping bag has no transverse support straps on the hammock support sheet.

In another embodiment of the first aspect, the first zipper closure is inwardly offset from the first edge by a first edge offset distance and the second zipper closure is inwardly offset from the second edge by a second edge offset distance, where the top quilt, the hammock support sheet, and the bottom quilt are stitched together at a single seam along the first edge, and where the top quilt, the hammock support sheet, and the bottom quilt are stitched together at a single seam along the second edge.

In another embodiment of the first aspect, the first edge offset distance is 5 centimeters and the second edge offset distance is 5 centimeters.

In another embodiment of the first aspect, the hammock sleeping bag also includes a stuff sack configured to fit the top quilt, hammock support sheet, and bottom quilt, when in a compressed condition, where the stuff sack is affixed to and integral to the hammock sleeping bag.

In another embodiment of the first aspect, the hammock sleeping bag where the stuff sack also has a head end aperture and a foot end aperture, so that when the hammock sleeping bag is in a compressed position inside the stuff sack, the head end hang strap may extend through the head end aperture and the foot end hang strap may extend through the head end aperture, and so that when a user desires to deploy the hammock sleeping bag, the user may pull the head end strap and the hammock sleeping bag will exit the stuff sack and through the foot end aperture.

In another embodiment of the first aspect, the hammock sleeping bag also has a top quilt draft tube affixed to the first zipper closure, such that when the first zipper closure is closed, the top quilt draft tube is inside of the top quilt and positioned such that the top quilt draft tube will reduce drafts passing through the first zipper closure.

In another embodiment of the first aspect, the hammock sleeping bag also has an insulated foot pocket.

In another embodiment of the first aspect, the hammock sleeping bag also has a removable rain fly.

In another embodiment of the first aspect, the hammock sleeping bag has the rain fly enhanced to have an integrated lightweight LED strip and an integrated battery, for providing illumination.

In another embodiment of the first aspect, the hammock sleeping bag, where the head end of the hammock support sheet is, folded upon itself, stitched, and gathered, so as to create a head end hammock support sheet tunnel loop and where the head end hang strap is inserted through the hammock support sheet tunnel loop, and where the foot end of the hammock support sheet is gathered, folded upon itself, and stitched, so as to create a foot end hammock support sheet tunnel loop, and where the foot end hang strap is inserted through the foot end hammock support sheet tunnel loop.

BRIEF DESCRIPTION OF THE DRAWINGS

In the descriptions that follow, like parts or steps are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein.

DESCRIPTION OF THE EMBODIMENTS

Figure 1:
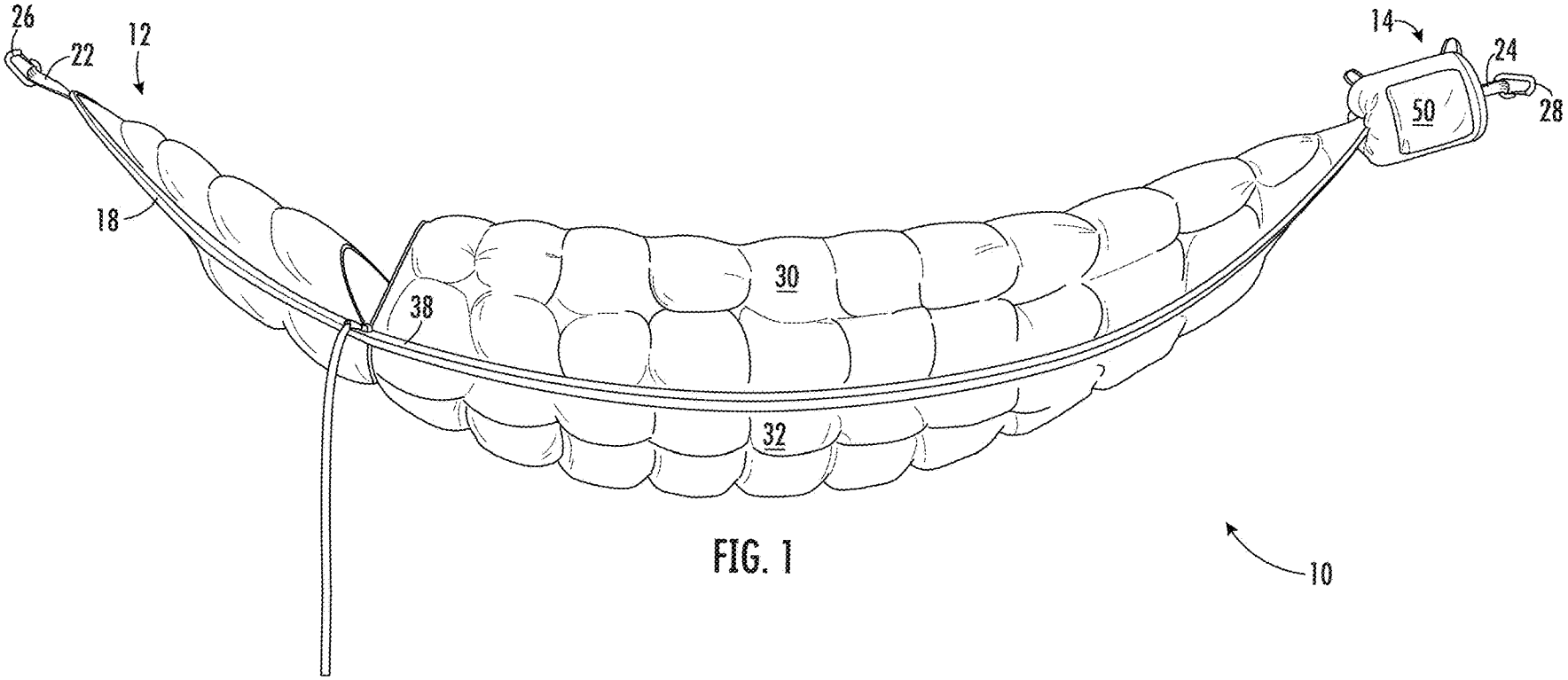
FIG. 1 illustrates a side view of an embodiment of the hammock sleeping bag disclosed herein, with both the top quilt and the bottom quilt engaged.

With reference to FIGS. 1-15, multiple embodiments of a hammock sleeping bag are disclosed. Embodiments of the hammock sleeping bag 10 include a head end 12, a foot end 14, a left support strap 16 extending from the head end 12 to the foot end 14 and a right support strap 18 extending from the head end 12 to the foot end 14. The left support strap 16 and the right support strap 18 are sometimes referred to as "dynema straps." Disposed between the right support strap 16 and the left support strap 18 is a hammock support sheet 20. The right support strap 16 and the left support strap 18 are configured to end in a head hang loop 22 and a foot hang loop 24. A pair of carabiners 26, 28 may be engaged with the head hang loop 22 and the foot hang loop 24, respectively. Each carabiner 26, 28 may be engaged to an existing support at a campsite, such as a post or a tree. In use, a user may lay down on the hammock support sheet 20, and the user's weight will be distributed by the hammock support sheet 20, to the left support strap 16 and the right support strap 18, and then to the head hang loop 22 and the foot hang loop 24, and then to the carabiners 26, 28. This configuration of dyneema straps helps with weight distribution and prevents any extra sag in the system. With respect to FIGS. 16-25A-E, an alternative embodiment of a hammock sleeping bag 110 is illustrated. This embodiment dispenses with the left support strap and the right support strap, and instead distributes a user's weight to the head hang loop 122 and the foot hang loop 124 simply by utilizing a suitable fabric that can carry at least the average weight of an adult camper, and by using a fabric tunnel loop discussed further below.

Figure 2:
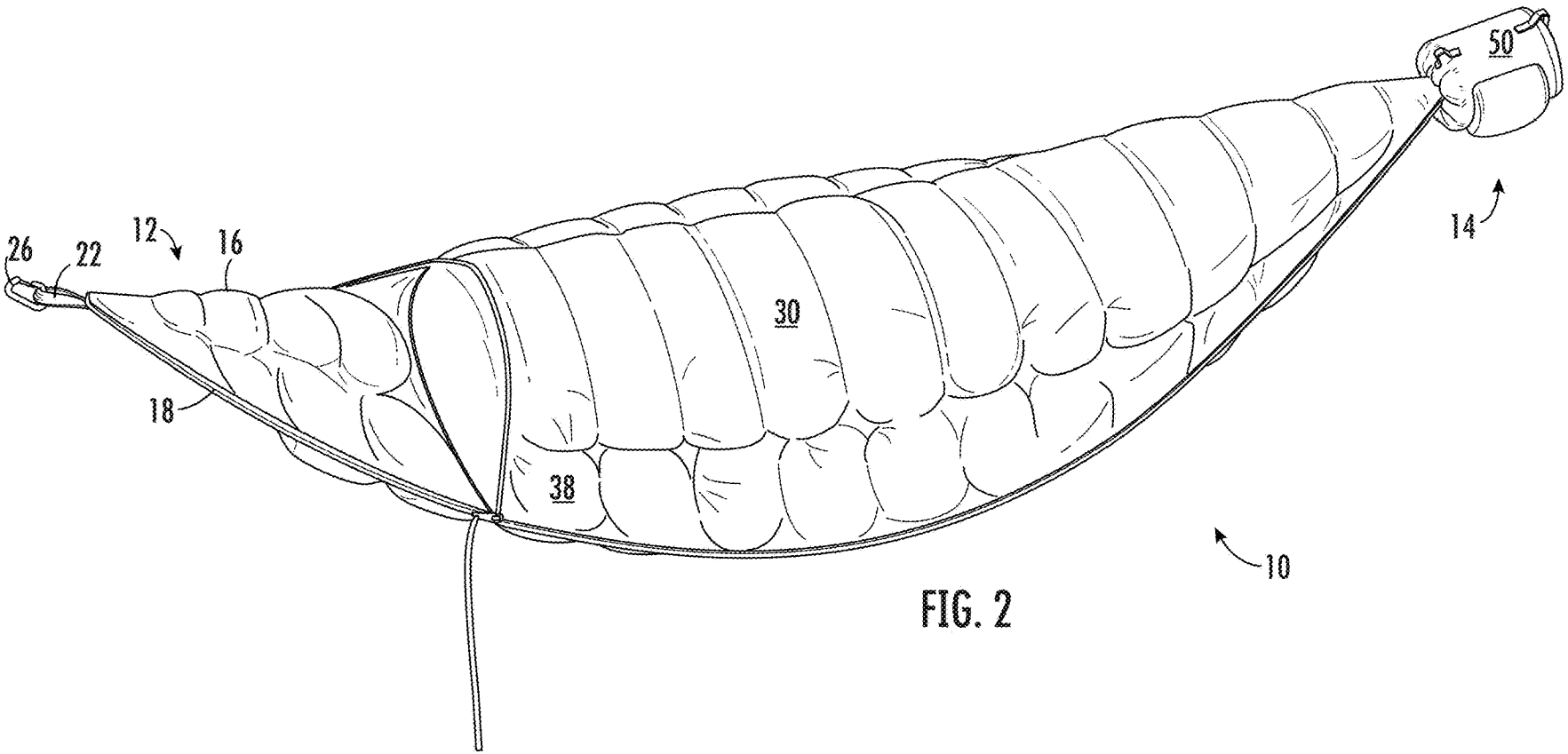
FIG. 2 illustrates a top view of an embodiment of the hammock sleeping bag disclosed herein, with the top quilt and bottom quilt engaged.
Figure 3:
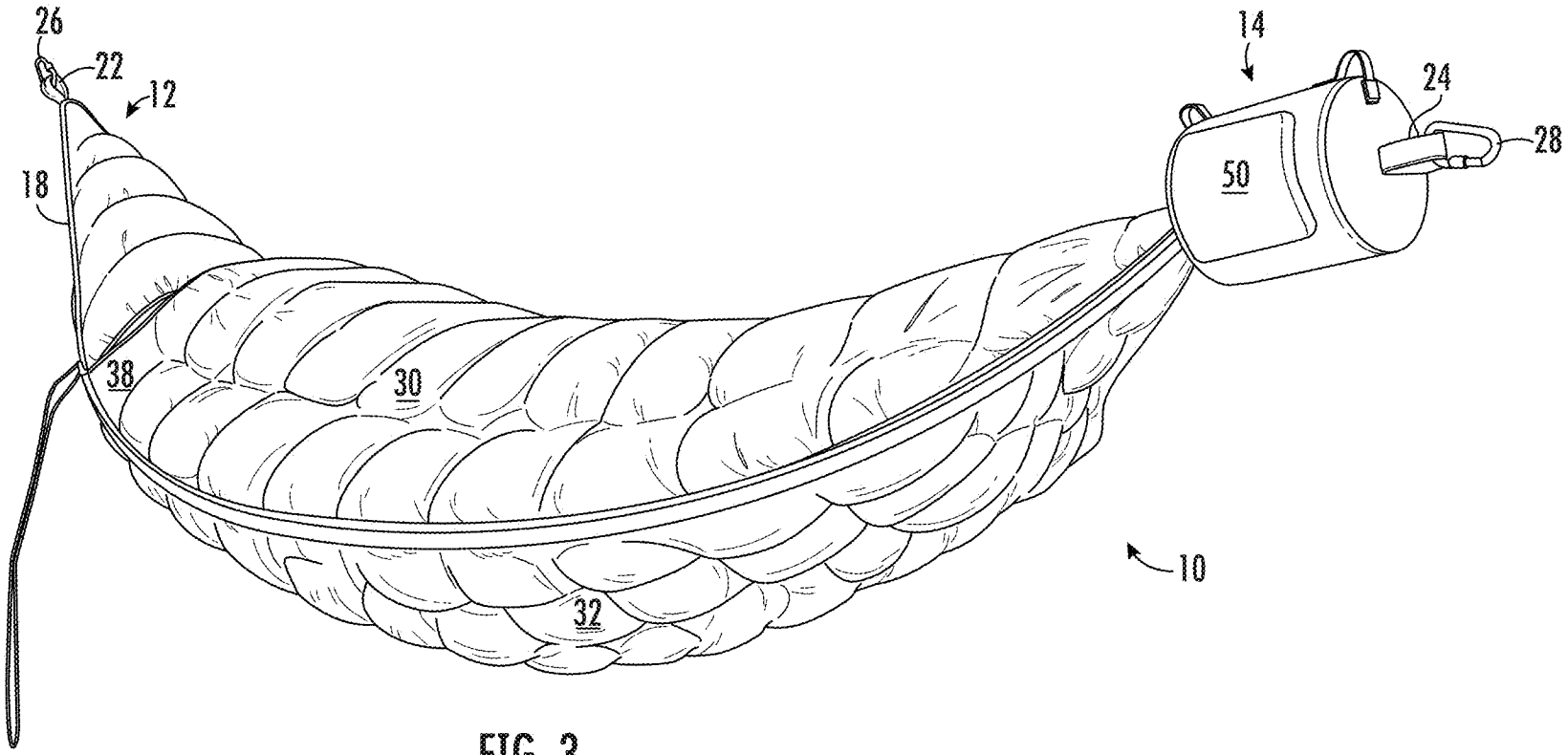
FIG. 3 illustrates a perspective view, from the foot end, showing further detail of the built-in quick deploy stuff sack, and which further illustrates the foot-end attachment carabiner, connected to the foot end hang loop, which in turn is either integral with, or affixed to, the bag support lines running along either side of the bag.
Figure 4:
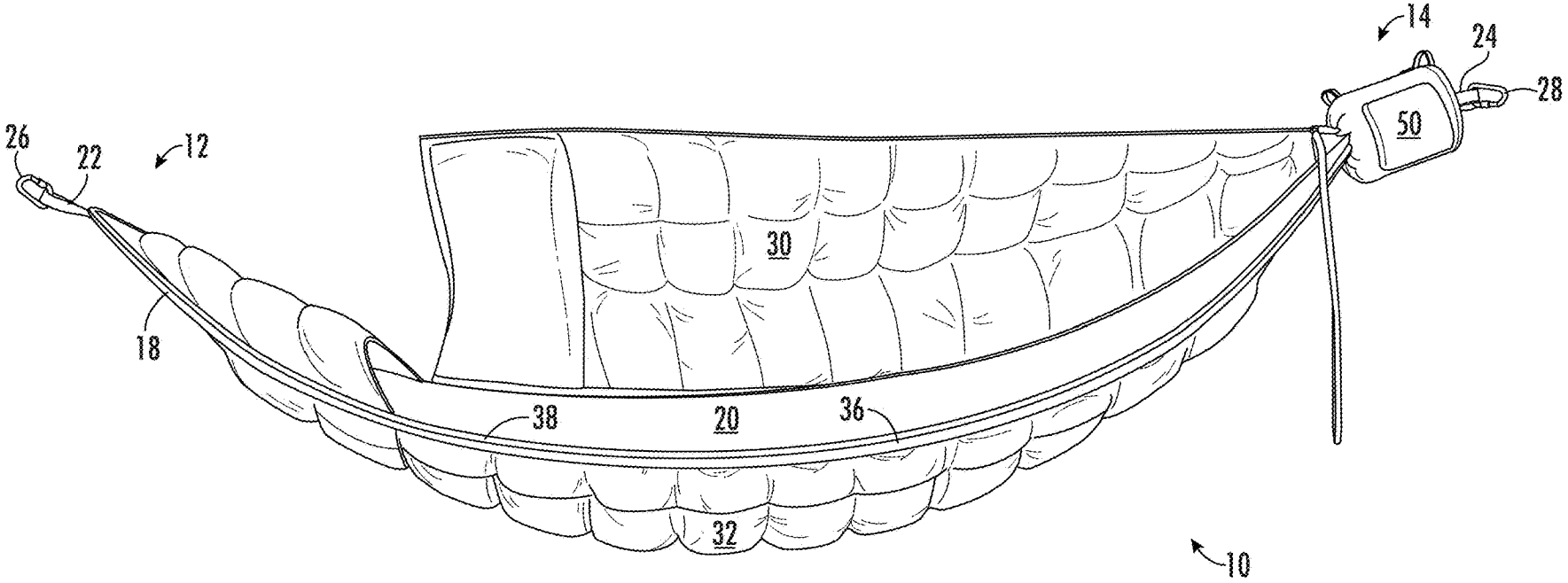
FIG. 4 illustrates a side view of the FIG. 1 embodiment, showing the top quilt being lifted in preparation of folding.
Figure 5:
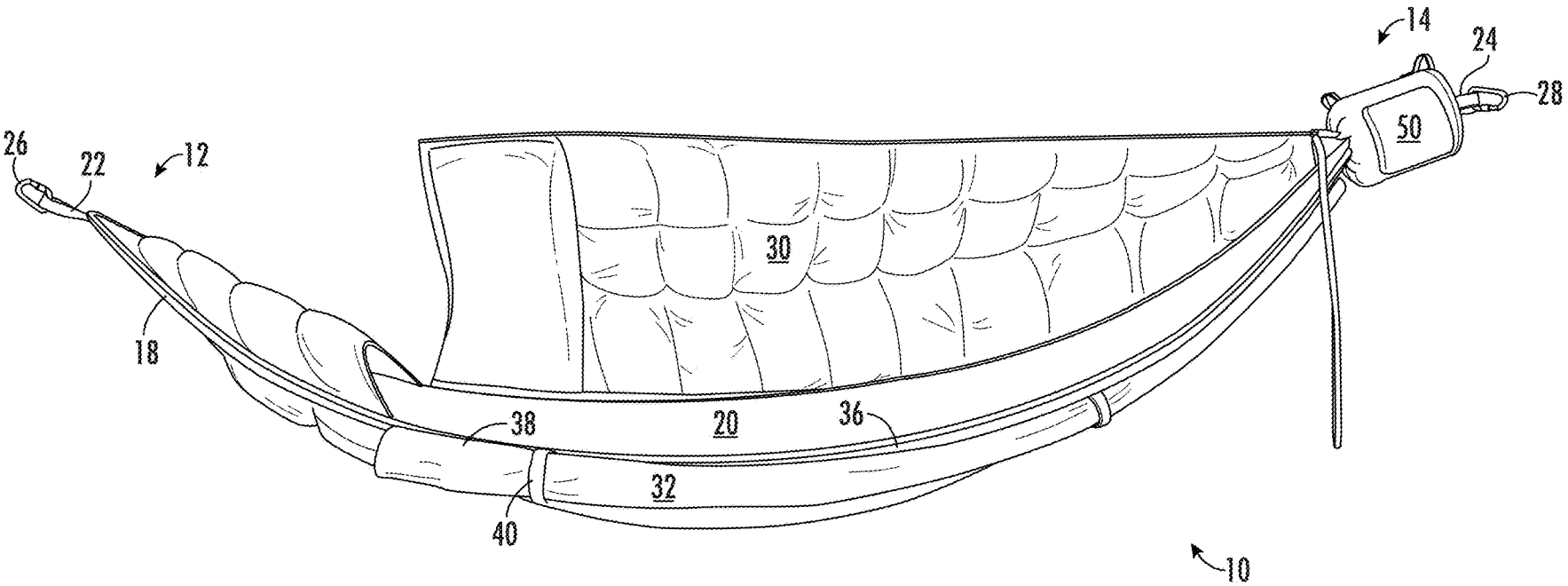
FIG. 5 illustrates a side view of the FIG. 1 embodiment, showing both the top quilt being lifted in preparation of folding, and the bottom quilt rolled away and stowed by one or more bottom quilt tie down closures.
Figure 6:
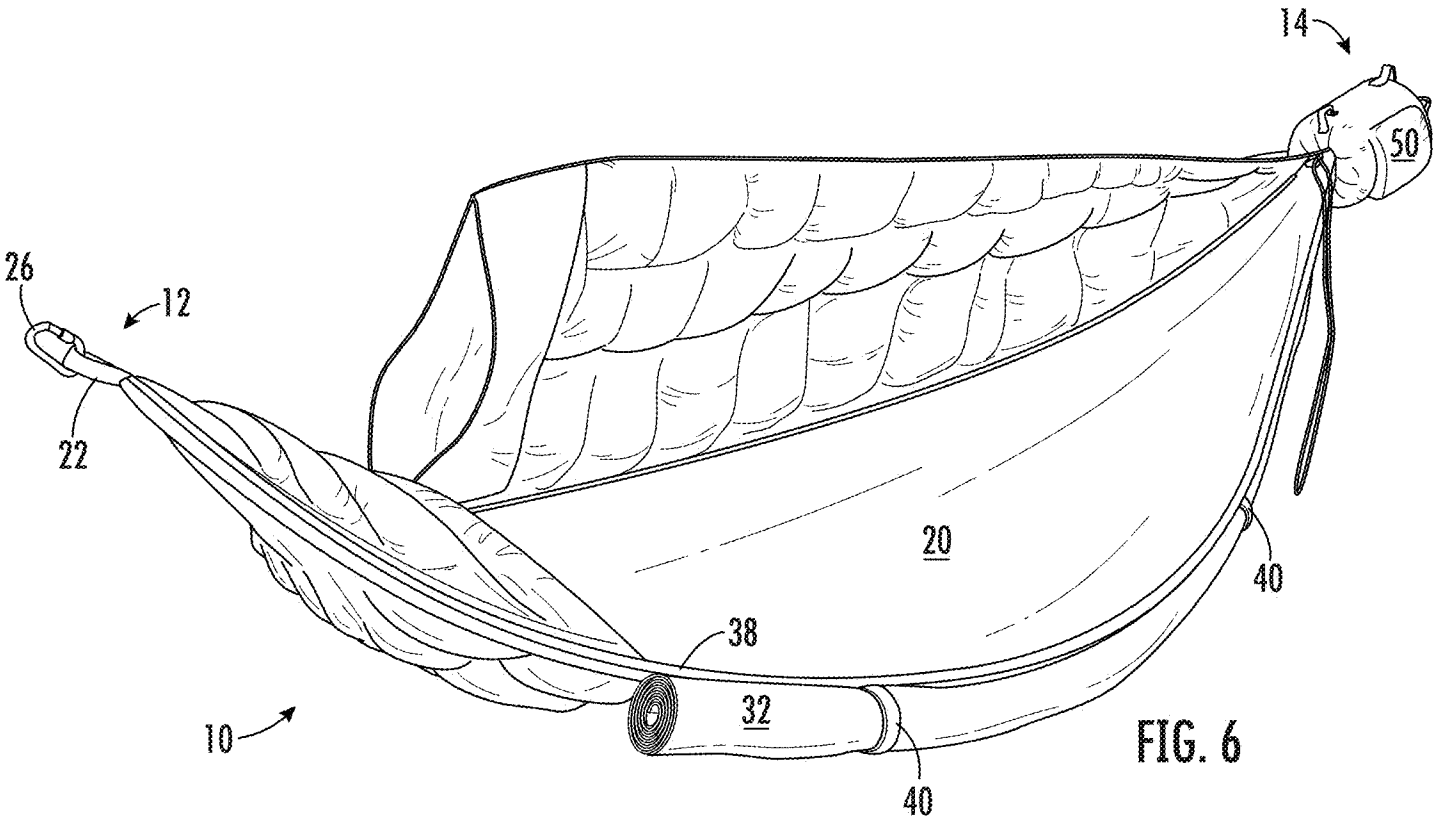
FIG. 6 illustrates a top perspective view, from the head end, showing both the top quilt being lifted in preparation of folding, and the bottom quilt rolled away and stowed by one or more bottom quilt tie down closures.
Figure 7:
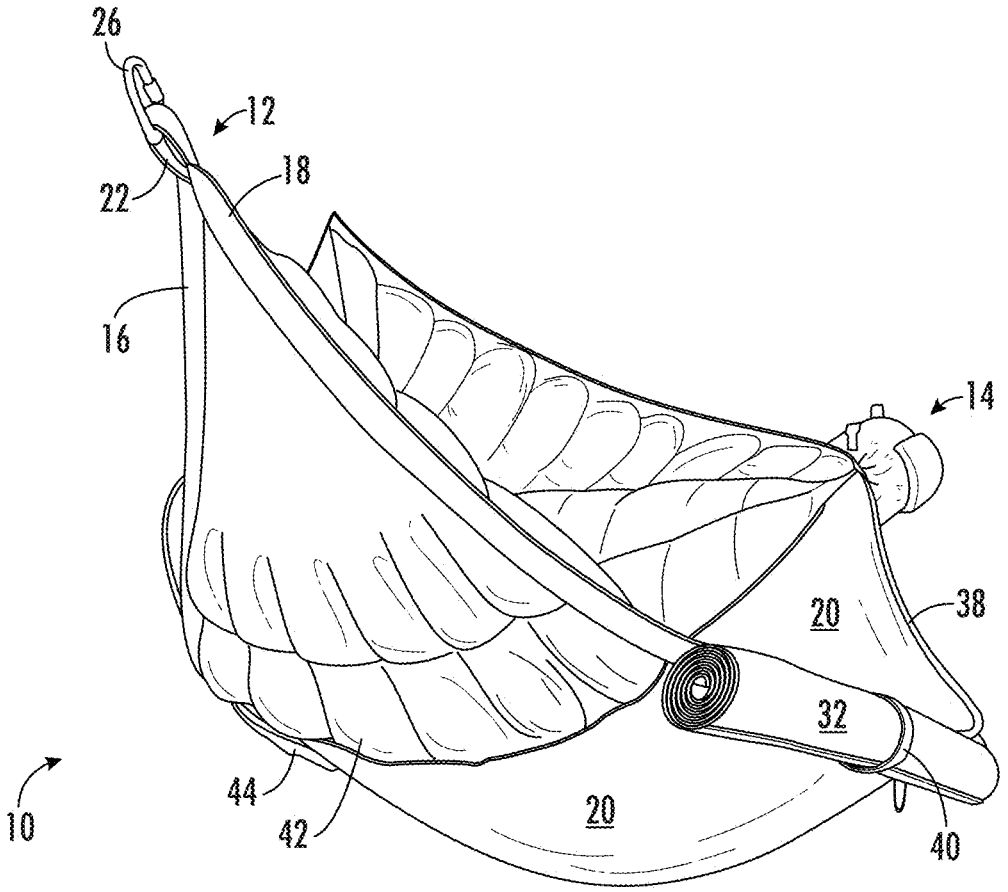
FIG. 7 illustrates a bottom perspective view, from the head end, showing both the top quilt being lifted in preparation of folding, and the bottom quilt rolled away and stowed by one or more bottom quilt tie down closures.

The hammock sleeping bag 10 includes a top blanket 30 and a bottom blanket 32. The top blanket 30 and/or the bottom blanket 32 may be quilted, baffled, or otherwise include the insulation and fabric types used in sleeping bags, including nylon, rip-stop nylon, and Dacron. Herein, Applicants variously also refer to the top blanket 30 as a top quilt, and also refer to the bottom blanket 32 as a bottom quilt. These terms are intended to be interchangeable, regardless of the insulation system, fabric, fill, or baffle structure used in the top blanket 30 and/or bottom blanket 32. While various embodiments are disclosed herein, in general, the top blanket 30 is affixed to one or more of the left support strap 18 or the left edge 34 of the hammock support sheet 20; or alternatively, is affixed to one or more of the right support strap 16 or the right edge 36 of the hammock support sheet 20. Then, the opposite edge of the top blanket 30 may be removably attached to the other support strap, or the other edge of the hammock support sheet 20 by a zipper 38, Velcro, clips, or other similar means. For example, for an embodiment in which one edge of the top blanket 30 is affixed to the left support strap 18, the opposite edge of the top blanket 30 is removably attached to the right support strap 16 by a zipper 38. As illustrated in FIGS. 1-3, this enables the top blanket 30 to be in a closed position, with the zipper 38 engaged, so that a user that is laying on the hammock support sheet 20 will be covered. As illustrated in FIGS. 4-7, this configuration also enables the top blanket 30 to be in an open position, with the zipper 38 disengaged, so that a user lying on the hammock support sheet 20 is uncovered. The top blanket 30 may be secured in an open, rolled-up position by any suitable closure, including straps 40, Velcro, or clips.

While various embodiments are disclosed herein, in general, the bottom blanket 32 is affixed to one or more of the left support strap 18 or the left edge 34 of the hammock support sheet 20; or alternatively, is affixed to one or more of the right support strap 16 or the right edge 36 of the hammock support sheet 20. Then, the opposite edge of the bottom blanket 32 may be removably attached to the other support strap or other edge of the hammock support sheet 20 by a zipper 42, Velcro, clips, or other similar means. For example, for an embodiment in which one edge of the bottom blanket 32 is affixed to the left support strap 18, the opposite edge of the bottom blanket 32 is removably attached to the right support strap 16 by a zipper 42. As illustrated in FIGS. 1-3, this enables the bottom blanket 32 to be in a closed position, with the zipper 40 engaged, so that a user that is laying on the hammock support sheet 20 will have the user's back side insulated, as in a normal sleeping bag. However, as illustrated in FIGS. 4-7, this configuration also enables the bottom blanket 32 to be in an open position, with the zipper 40 disengaged, so that a user lying on the hammock support sheet 20 does not have the user's back insulated. The bottom blanket 32 may be secured in an open position by any suitable closure including straps, 44 Velcro, or clips.

The above-described embodiments and configurations provides many benefits. By having the user's weight distributed through the hammock support sheet 20, either via the left support strap 18 and the right support strap 16, or via the hammock support sheet 20 alone, and thus through to the head hang loop 22, and the foot hang loop 24, the user may lay down in the hammock sleeping bag 10 with his weight supported as a hammock, without hard points or transverse straps causing any discomfort to the user. The top blanket 30 and bottom blanket 32 configuration allows the user to make adjustments to their warmth while sleeping, to either add or remove a top blanket 30, or bottom blanket 32, as needed. A further advantage of this configuration is that the bottom blanket 32 does not bear significant weight of a user, or in some embodiments, any of the user's weight at all. As a result, the insulation (or loft) of the bottom blanket 32, when in use, is not compressed. By maintaining the loft of the insulation of the bottom blanket 32, the bottom blanket 32 is better able to retain warmth. This will also prevent heavier sleepers from overloading the baffled sections of the bottom blanket 32, thus keeping the system warm.

Other advantages of the disclosed embodiments of the hammock sleeping bag 10, and the fact that the top blanket 30 and the bottom blanket 32 are affixed to and/or integral with the hammock support sheet (as opposed to being a sleeping bag that can be wrapped around a pre-existing hammock), are that the user can adjust either the top blanket 30, or the bottom blanket 32 to meet the comfort needs depending on the climate. The user can unzip the bottom blanket 32 slightly or roll-up the bottom blanket 32 completely to the side to accommodate their ventilation comfort levels. The same approach applies for the top blanket 30. In some embodiments, the blankets are removably attached by 2-way zippers. By configuring the blankets as disclosed, including with the use of removably attaching the blankets with 2-way zippers, the disclosed embodiments offer an integral insolation system. In contrast, prior art systems require multiple add-ons, such as separate underquilts, separate sleeping bags that are rolled out onto a hammock, and/or separate sleeping pads.

In various embodiments, significant weight savings can result. A typical adventurer (camper, backpacker, hunter, etc.) will pack a variety of items to meet their sleeping needs. This impacts not only the weight that the user must consider, but also impacts the volume the items take-up in the users' backpack.

A typical prior art pack would include: (1) a sleeping bag (2-4 lbs); (2) a sleeping pad (1 lbs); (3) a hammock (1 lbs); (4) a tent (4 lbs); and (5) a rain fly (15 oz), and amount to roughly 10 lbs.

In contrast, embodiments of the hammock sleeping bag system disclosed herein will normally include: (1) the hammock sleeping bag (4-5 lbs); and (2) a rain fly (1 lbs), and amount to roughly 6 lbs.

Figure 8A:
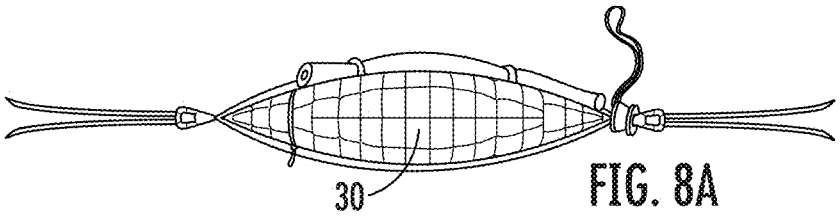
FIGS. 8A-D schematically illustrates three four different embodiments of the hammock sleeping bag, each of which has a different configuration for rolling or bundling the bottom quilt when not in use by a user.
Figure 8B:
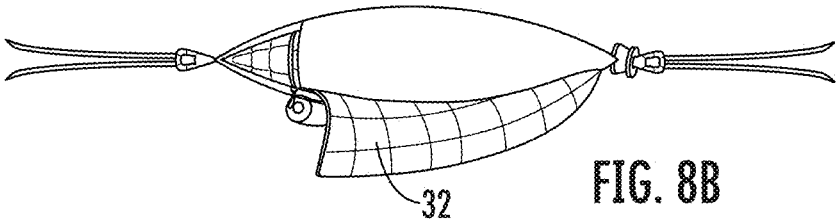
Figure 8C:
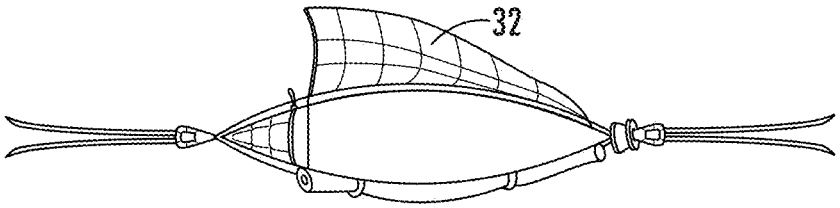
Figure 8D:
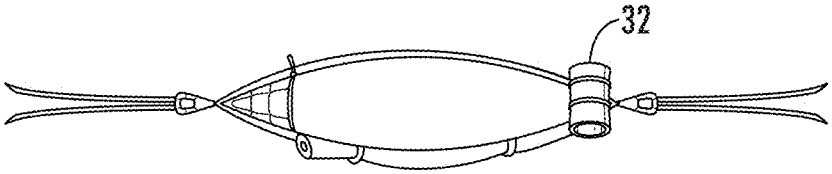
Figure 9:
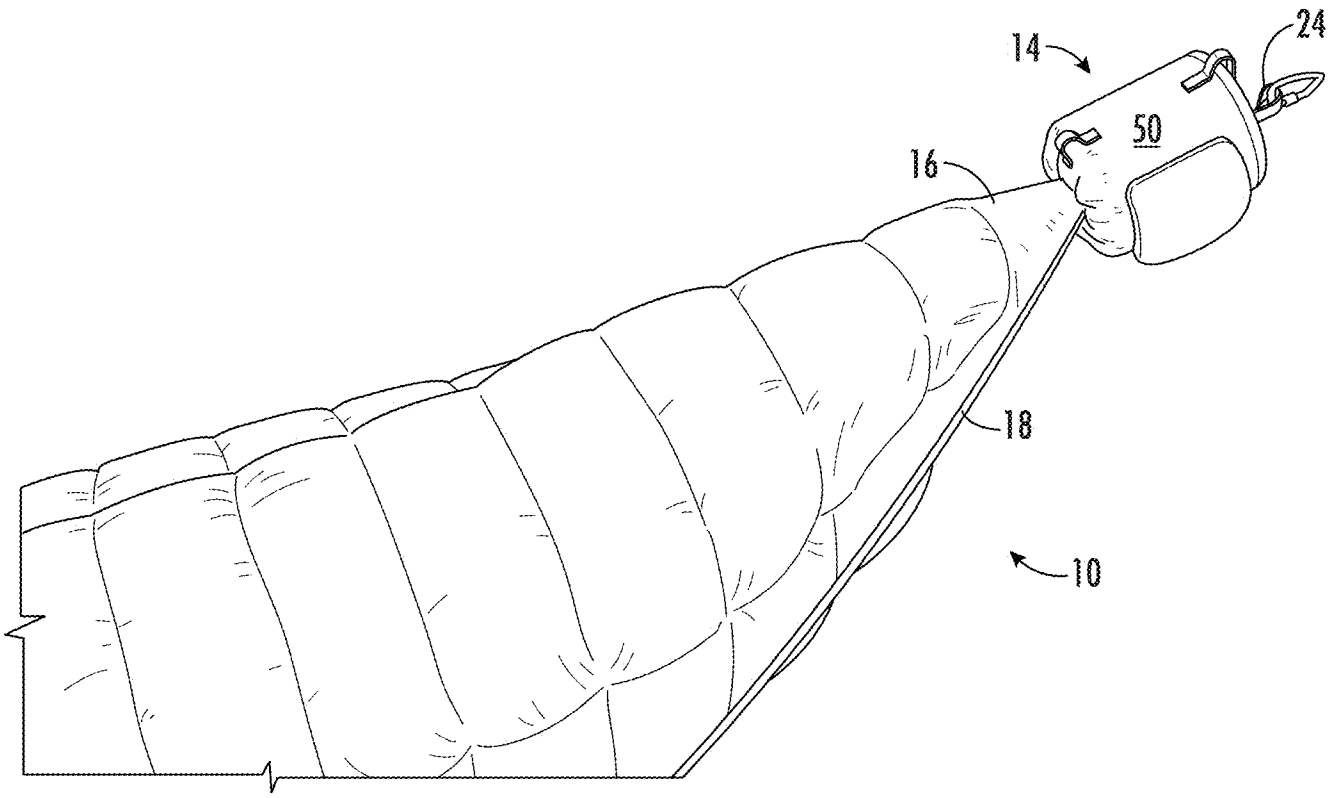
FIG. 9 illustrates a close-up view of the foot end of an embodiment of the hammock sleeping bag, showing the built-in quick deploy stuff sack, and which further illustrates the foot-end attachment carabiner, connected to the foot end hang loop, which in turn is either integral with, or affixed to, the bag support lines running along either side of the bag.
Figure 10:
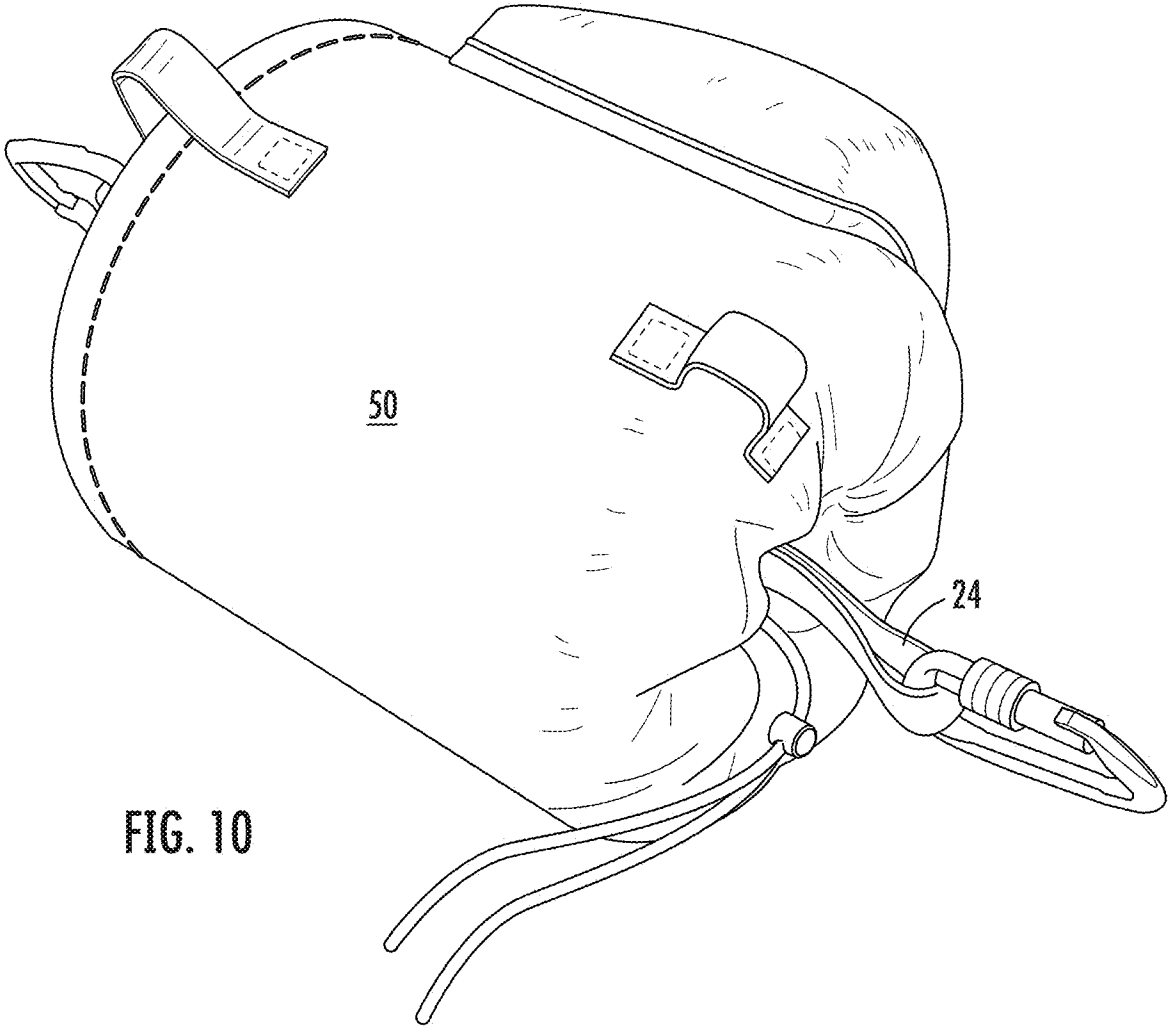
FIG. 10 illustrates a perspective view of the hammock sleeping bag, from the head end, where the entire bag has been stowed into the built-in quick deploy stuff sack, and which further illustrates the head-end attachment carabiner, connected to the head end hang loop, which in turn is either integral with, or affixed to, the bag support lines running along either side of the bag.
Figure 11:
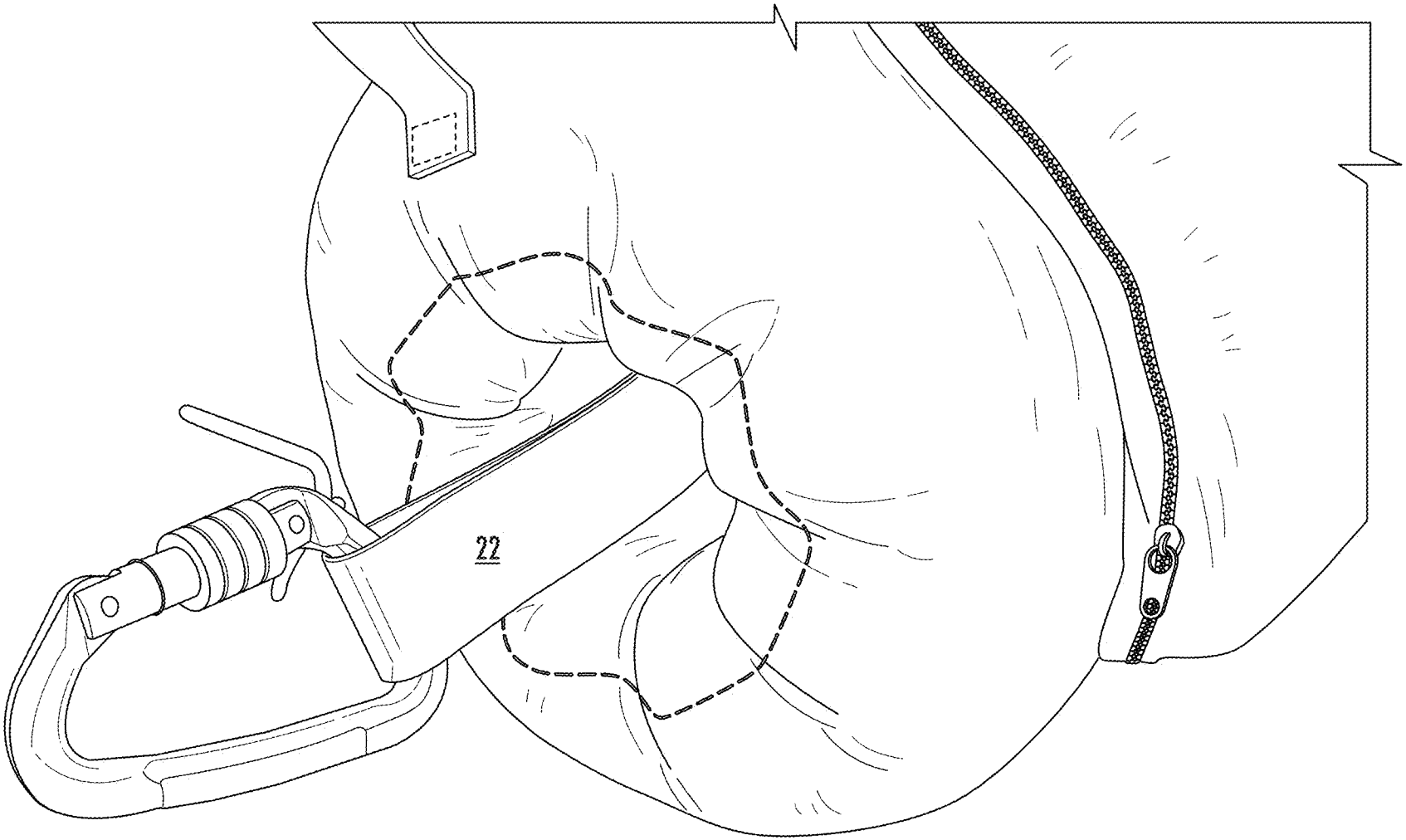
FIG. 11 illustrates a close-up perspective view of the built-in-quick deploy stuff sack, from the head end, where the entire bag has been stowed into the built-in quick deploy stuff sack.

With reference to FIGS. 8A-C, three different embodiments of the bottom blanket 32 are shown. Each provides a different configuration of how the bottom blanket 32 is attached to the hammock sleeping bag 10, and of how the bottom blanket 32 may be rolled and bundled when not in use. Specifically, in the embodiment of FIG. 8A, the bottom blanket 32 may be rolled and bundled on the same side as the top blanket 30. In the embodiment of FIG. 8B, the bottom blanket 32 rolls and bundles on the opposite side as the top blanket 30. In the embodiment of FIG. 8C, the bottom blanket 32 rolls down and bundles at the foot end 14. Applicants suggest that the best mode for rolling up the bottom blanket is the "opposite sides" approach of the FIG. 8B embodiment.

Figure 12:
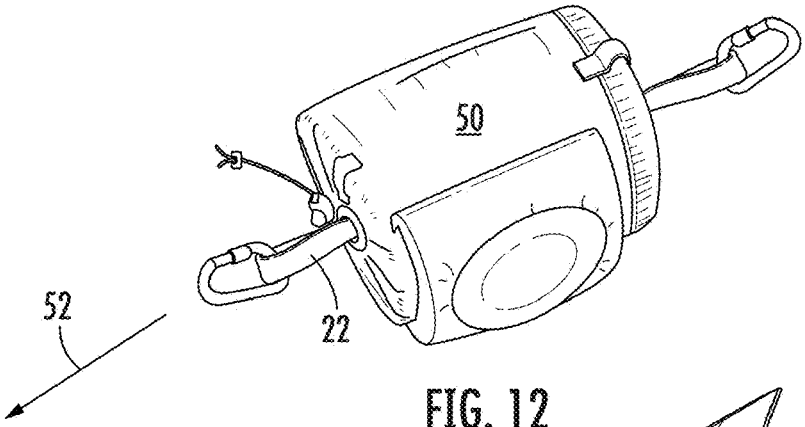
FIG. 12 schematically illustrates the built-in quick deploy stuff sack, with an arrow showing how the hammock sleeping bag can be drawn out of the sack for use.

With reference to FIGS. 9-12, some embodiments of the hammock sleeping bag 10 include a built-in quick deploy stuff sack 50. As shown, the built-in quick deploy stuff sack 50 is positioned at the foot end 14 of the hammock sleeping bag 10. In embodiments including a built-in quick deploy stuff sack and the left and right support strap configuration, the left support strap 18 and the right support strap 16 pass through the built-in quick deploy stuff sack 50 to the foot hang loop 24. This configuration prevents weight from compressing or pulling the stuff sack when a user is in the hammock sleeping bag. When the user stows the hammock sleeping bag 10 for transport or storage, the entire hammock support sheet 20, the left support strap 18, the right support strap 16, the top blanket 30, and the bottom blanket 32 may be compressed into the built-in quick deploy stuff sack, 50 as illustrated in FIG. 12. When ready for use, the user may pull the head hang loop 22 in the direction of the arrow 52, to deploy the entire hammock sleeping bag. Alternatively, the stuff sack may be configured such that the user may pull the foot hang loop 24 to deploy the entire hammock sleeping bag.

Figure 13:
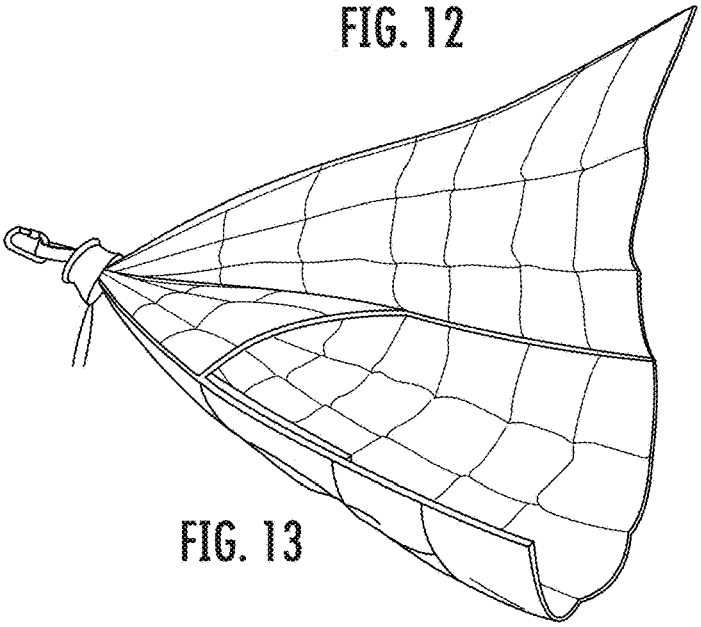
FIG. 13 schematically illustrates an embodiment of the hammock sleeping bag with an insulated foot pocket at the foot end.
Figure 14:
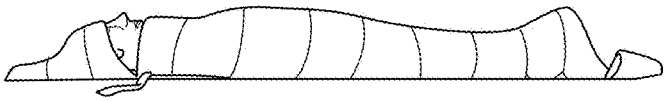
FIG. 14 schematically illustrates how embodiments of the hammock sleeping bag may be used in a bivouac setup on the ground.
Figure 15:
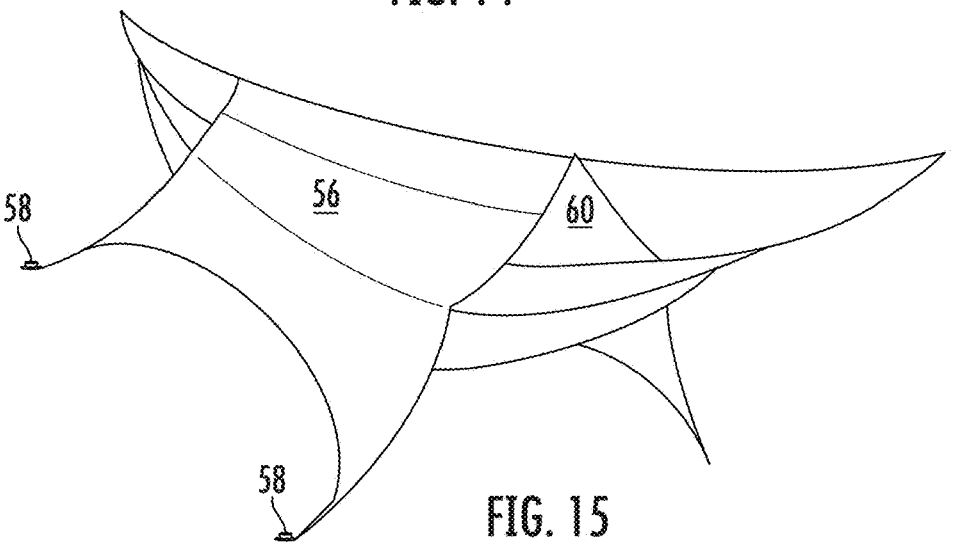
FIG. 15 schematically illustrates an embodiment of the hammock sleeping bag that is outfitted with an optional rain fly that is equipped with an integral lightweight LED strip and an integral battery to provide lighting for the user of the sleeping bag.

Other features are illustrated in FIGS. 13-15. FIG. 13 shows an embodiment with an insulated foot pocket 54 affixed at the foot end of the hammock sleeping bag 10. FIG. 14 shows an embodiment of the hammock sleeping bag 10 being used on the ground—rather than as a hammock—in what is referred to as a bivouac setup. FIG. 15 shows a schematic of an optional rain fly 56 in place, over the top of the deployed hammock sleeping bag 10. The optional rain fly 56 includes attachment points 58 to affix the optional rain fly 56 to the ground. The optional rain fly 56 may also include one or more strips of lightweight LEDs 60, so that a user may have illumination when using the hammock sleeping bag 10. In some embodiments, the LEDs 60 will be positioned down the center of the rain fly 56 and will be powered by a small rechargeable battery pack. It will be flexible and lightweight.

Figure 16A:
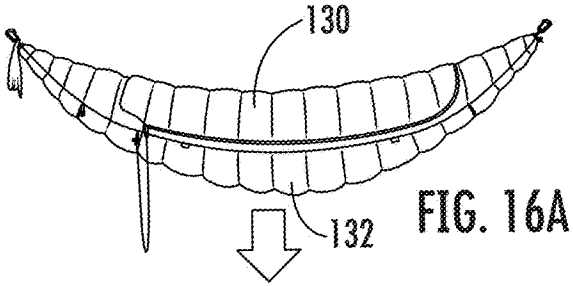
FIG. 16A illustrates a side view of another embodiment of the hammock sleeping bag, where the hammock sleeping bag is in use and in a fully closed position.
Figure 16B:
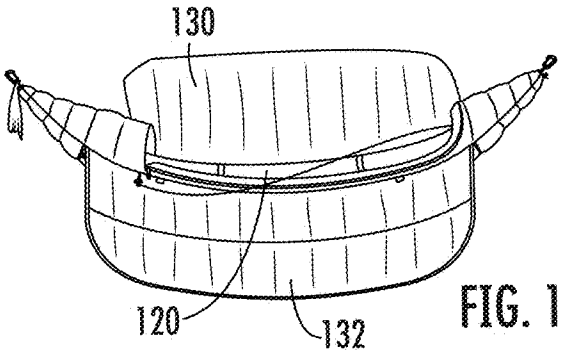
FIG. 16B illustrates a side view of the embodiment of FIG. 16A, where the hammock sleeping bag has the top quilt being opened, and the bottom quilt being opened.
Figure 16C:
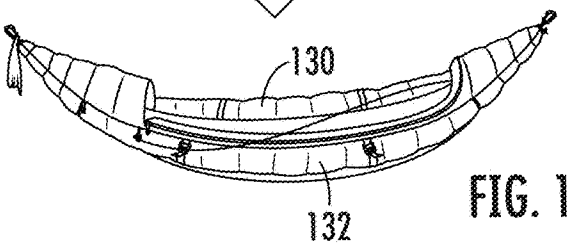
FIG. 16C illustrates a side view of the embodiment of FIG. 16A, where the hammock sleeping bag has the top quilt rolled and stowed on one side of the hammock support sheet, and has the bottom quilt rolled and stowed on the other side of the hammock support sheet.
Figure 16:
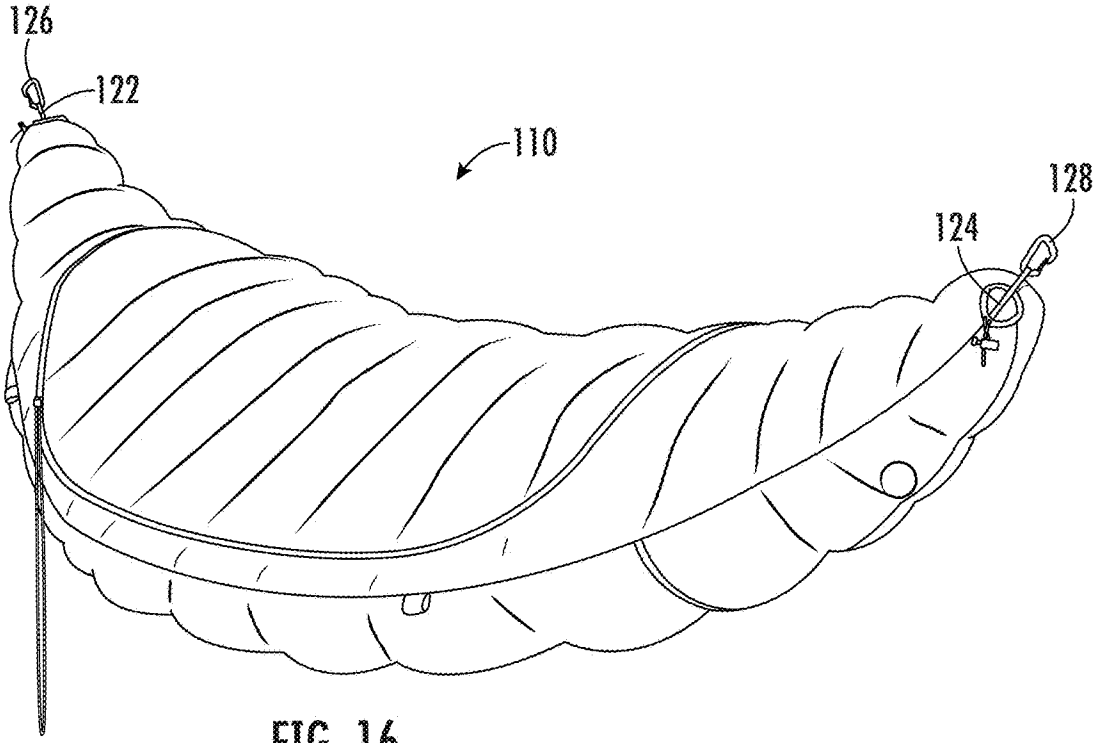
FIG. 16 illustrates a side perspective view of another embodiment of the hammock sleeping bag from the foot end, where the hammock sleeping bag is in use and in a fully closed position.

With reference to FIGS. 16-26E, additional embodiments are illustrated. While similar in concept and execution to the embodiment shown in FIGS. 1-15, the embodiments of FIGS. 16-26E show additional and alternative details. With respect to FIG. 16, and FIGS. 16A-C, an embodiment of the hammock sleeping bag 110 is illustrated without the left support strap or the right support strap. The hammock sleeping bag 110 has a similar configuration to hammock sleeping bag 10, with a hammock support sheet 120, an integral top blanket 130, which can be lifted (FIG. 16B) and rolled and stowed (FIG. 16C), an integral bottom blanket 132, which can be dropped (FIG. 16B) and rolled and stowed (FIG. 16C).

Figure 17:
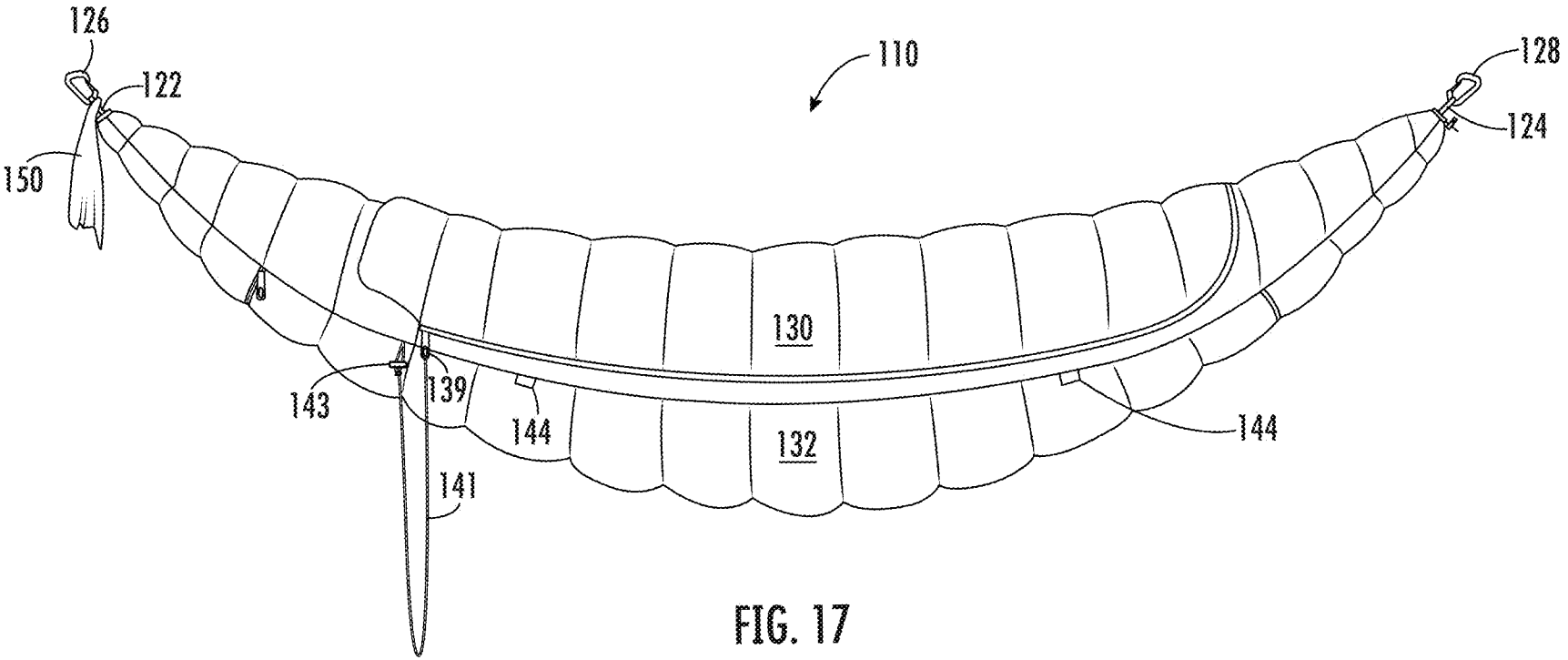
FIG. 17 illustrates a side view of the FIG. 16 embodiment.

With reference to FIG. 17, additional details regarding the configuration and construction of the hammock sleeping bag 110 are provided. The hammock sleeping bag may include carabiners 126, 128 removably attached to the head hang loop 122 and the foot hang loop 124. The carabiners 126, 128 may be of any material and configuration suitable to hold the weight of a camper when the hammock sleeping bag 110 is in use. Preferably, the carabiners 126, 128 are an asymmetric D-shape, include a wiregate, have a closed gate strength of at least 24 KN and an open gate strength of at least 8 KN, and are rated safe for climbing. The hammock sleeping bag 110 is configured to include an double-ended quick deploy stuff sack 150 for packing the hammock sleeping bag 110 when not in use. The double-ended quick deploy stuff sack 150 may be integral, or removable. The double-ended quick deploy stuff sack 150 has a head end aperture 158 and a foot end aperture 160, which enable the entire hammock, or simply the head hang loop 122 and the foot hang loop 124 to pass through the sack, for deployment as illustrated in FIG. 12 above. The top blanket 130 includes a top quilt face overlap 131 which may be either positioned in a closed position (as shown in FIG. 17) which enables a user to cover their face when the hammock sleeping bag is used in very cold temperatures. Alternatively, the top quilt face overlap 131 may be flipped down into an open position so that the user's face is exposed. The top blanket 130 is preferably insulated, using a box baffle stitch, with 90/10 duck down fill. This preferred configuration should provide a target temperature rating of 20° F., with a large total weight of less than 64 ounces. Similarly, the bottom blanket 132 is preferably of the same box baffle quilting, is insulated with the same 90/10 duck down fill, and is approximately the same weight as the top blanket 130. The hammock sleeping bag 110 has webbing loops 144 for securing straps (not shown) for rolling and securing the bottom blanket 132 and (on the opposite side) the top blanket 130. The top blanket 130 preferably has a top blanket zipper closure 138 that enables a user to zip up the top blanket 130 when in use. The top blanket zipper closure 138 has a zipper pull tab 139 to which is attached a top blanket zipper pull cord 141. In turn, the top blanket zipper pull cord 141 is attached—at its other end—to a top blanket zipper attachment point 143, which is located near to the head end 112 of the hammock sleeping bag 110, so that it is convenient for a user to grab the top blanket zipper pull cord 141 and use it to pull up the top blanket zipper closure 138 while in a seated position, without having to bend to reach—or even touch—the top zipper pull tab 139. Preferably, the top blanket zipper attachment point 143 is a fabric loop, through which a T-bar toggle attached to the top blanket zipper pull cord 141 is inserted.

Figure 18:
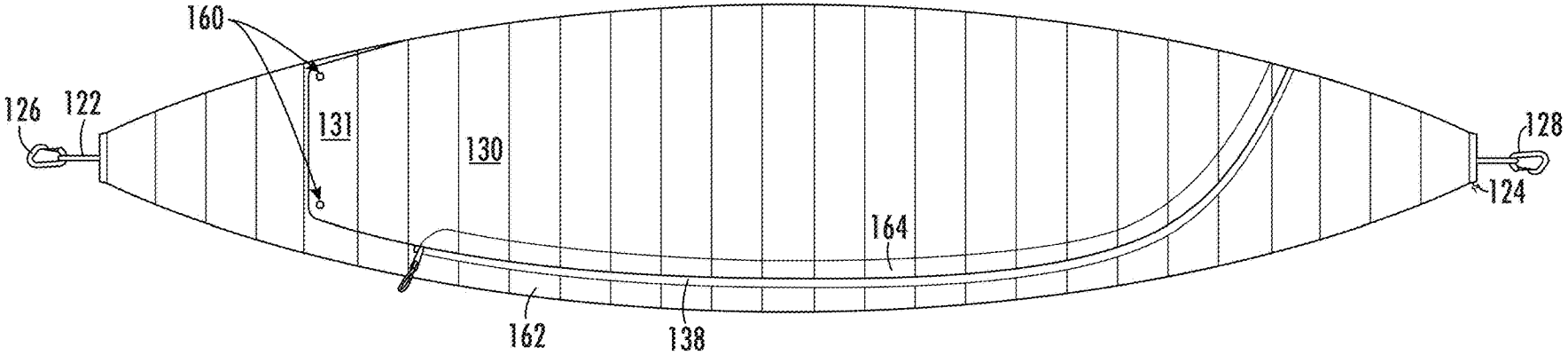
FIG. 18 illustrates a top plan view of the top quilt of the FIG. 16 embodiment.

With reference to FIG. 18, additional details of the top blanket are provided. FIG. 18 also illustrates exemplar dimensions; however, one of ordinary skill could modify these dimensions for different size users without substantial experimentation. In a preferred embodiment, closures, such as plastic snaps 160 are provided on the top quilt face overlap 131 so that the top quilt face overlap 131 may be secured in a closed position. The top blanket 130 also preferably includes configuring the top blanket zipper closure 138 with an inward offset 162 from the edge of the hammock support sheet 120. In one embodiment, this inward offset is approximate 5 cm. The top blanket 130 also preferably includes an insulated draft tube 164 behind and inside the top blanket zipper closure 138 to prevent drafts from passing through the teeth of the zipper and/or to prevent heat escaping through the closed (but un-insulated) top blanket zipper closure 138.

Figure 19:
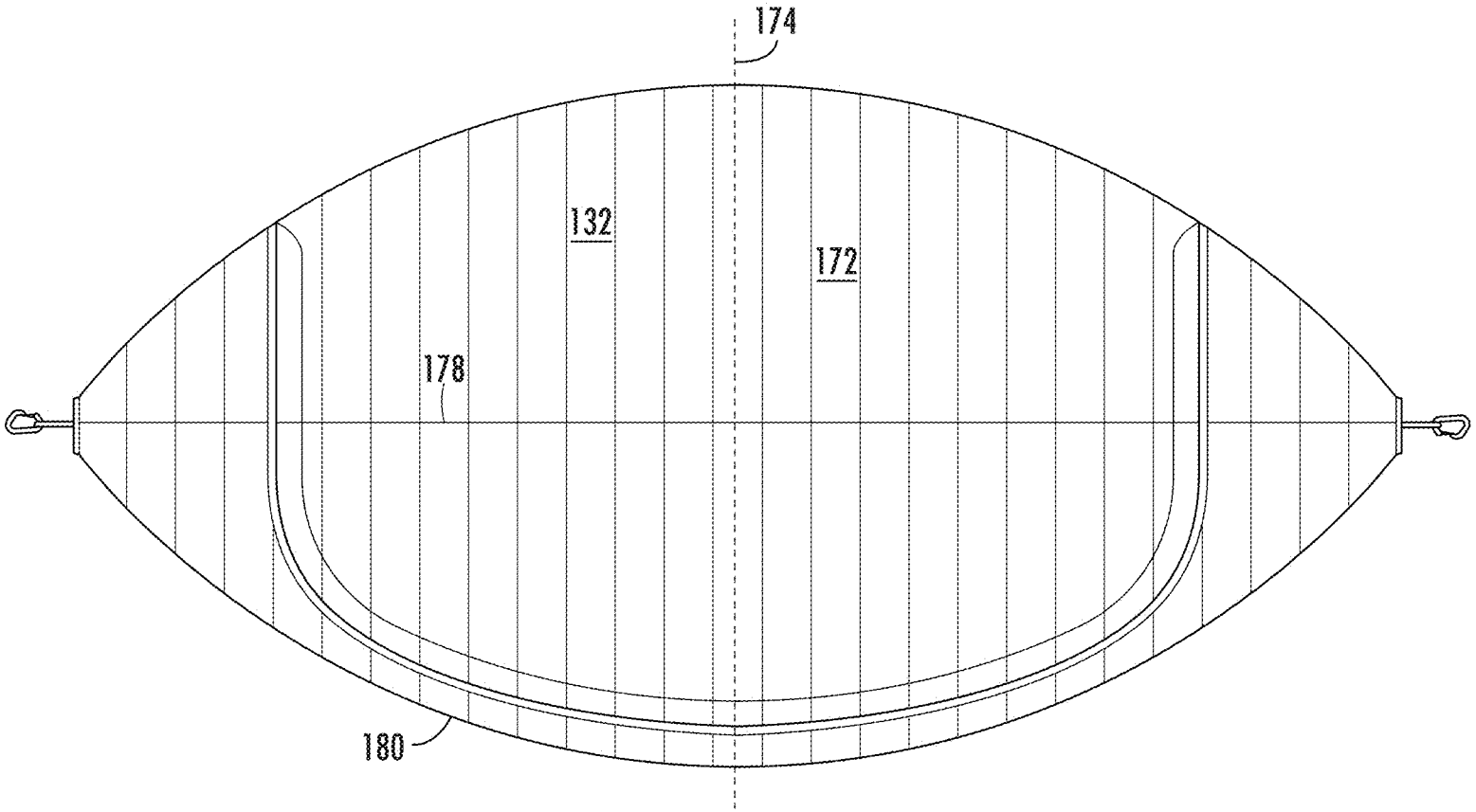
FIG. 19 illustrates a bottom plan view of the bottom quilt of the FIG. 16 embodiment.
Figure 24B:
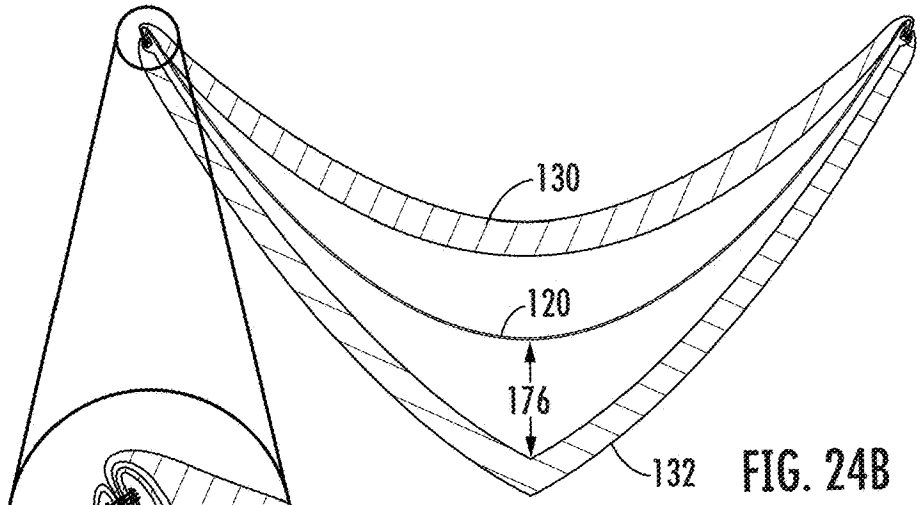
FIG. 24B illustrates a cross-sectional view of the FIG. 16 embodiment, along the cross-sectional indicator plane A.
Figure 24C:
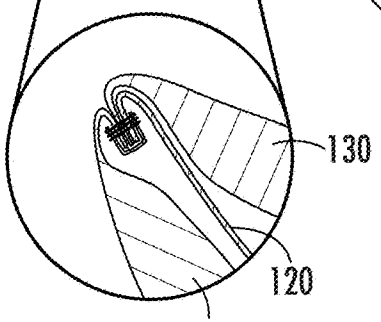
FIG. 24C illustrates an enlarged cross-sectional view of the seam detail of the FIG. 16 embodiment, along the cross-sectional indicator plane A.
Figure 24:
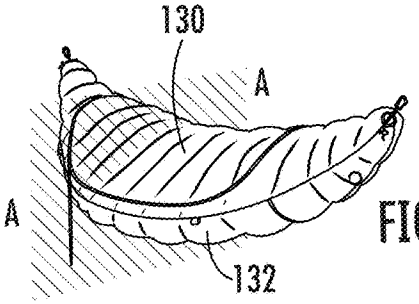
FIG. 24 illustrates the perspective view, from the foot end, of the embodiment of FIG. 16, with a cross-sectional indicator plane A.
Figure 24A:
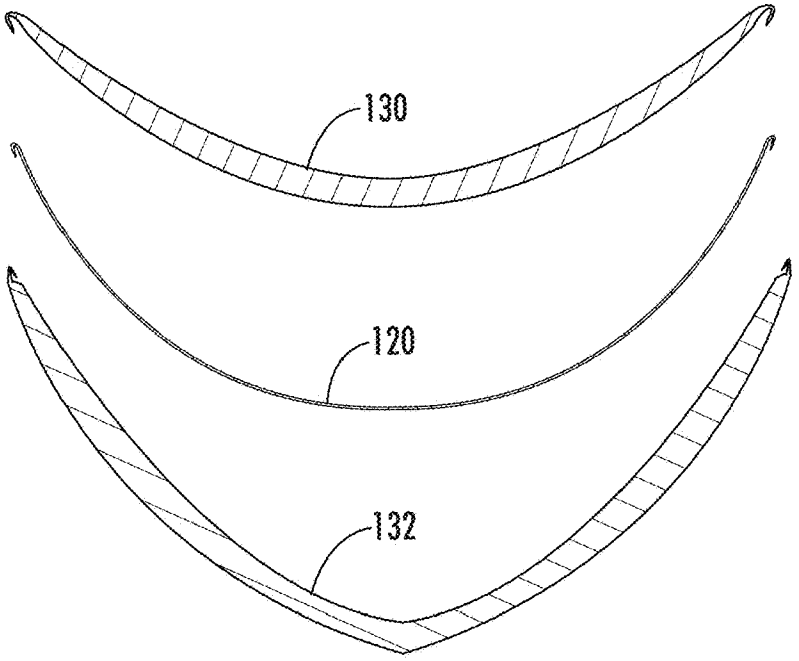
FIG. 24A illustrates a cross-sectional, exploded view of the FIG. 16 embodiment, along the cross-sectional indicator plane A.

With reference to FIG. 19, additional details of the bottom blanket are provided. FIG. 19 also illustrates exemplar dimensions; however, as with the top blanket, one of ordinary skill could modify these dimensions for different size users without substantial experimentation. In a preferred embodiment, the hammock support sheet 120 (of FIG. 21) has a measured first area 170, and the bottom blanket 132 has a measured second area 172. The second area 172 is greater than the first area, so that at an imaginary transverse mid-point line 174 of the bottom blanket 132, the bottom blanket 132 hangs lower than the hammock support sheet 120, and does not contact the hammock support sheet 120. Preferably, as illustrated in FIGS. 24A-B, this difference in areas makes the bottom blanket sag downward and creates an air gap 176 between the hammock support sheet 120 and the bottom blanket 132. This air gap 176 is at least present at the transverse mid-point line 174. However, in a preferred embodiment, this air gap 176 is present for at least the majority of the length of the hammock support sheet 120, and in a most preferred embodiment, this air gap 176 is present for the entire length of the hammock support sheet 120. The air gap 176 serves a dual purpose. First, the air gap 176 prevents the weight of a user, pressing down on the hammock support sheet 120 from pressing down on the bottom blanket 132 and thereby compressing the insulating baffles of the bottom blanket 132 and reducing the ability of the bottom blanket 132 to retain body heat. Second, the air gap 176 serves as a further insulating layer between the hammock support sheet 120 and the bottom blanket 132, trapping warmed air from the user's body heat. This configuration serves to retain warmth, and prevent a "cold spot" from forming on the user's back or the point at which the user's body is the lowest in the hammock support sheet 132 (depending on preferred sleeping position). The air gap 176 can be further augmented and created by forming the bottom blanket 132 from two sections and joining them with a centerline seam 178. This causes the bottom blanket 132 to form to a rounded V-shape, rather than a U-shape, as illustrated in FIG. 24B.

Figure 20:
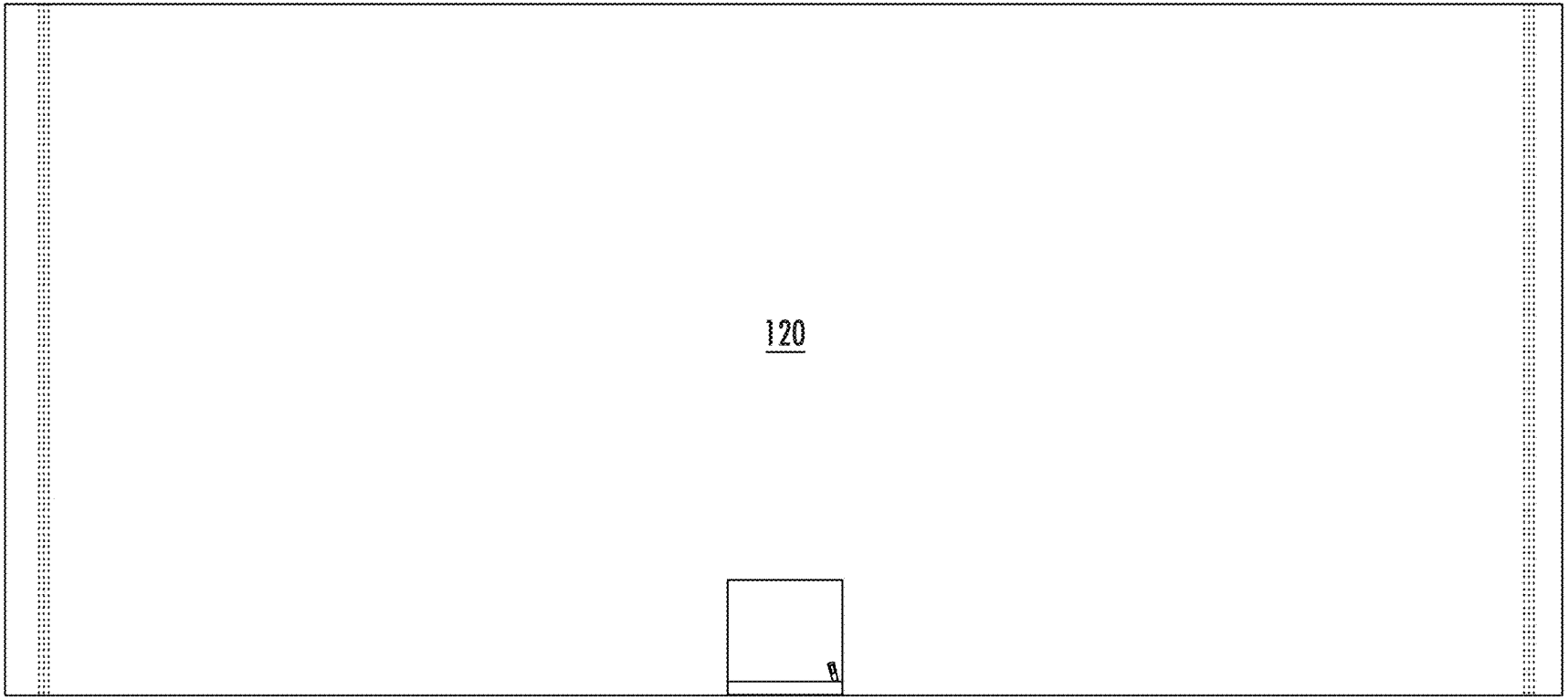
FIG. 20 illustrates a top plan view of the hammock support sheet of the FIG. 16 embodiment, when the hammock support sheet is laid flat.
Figure 21:
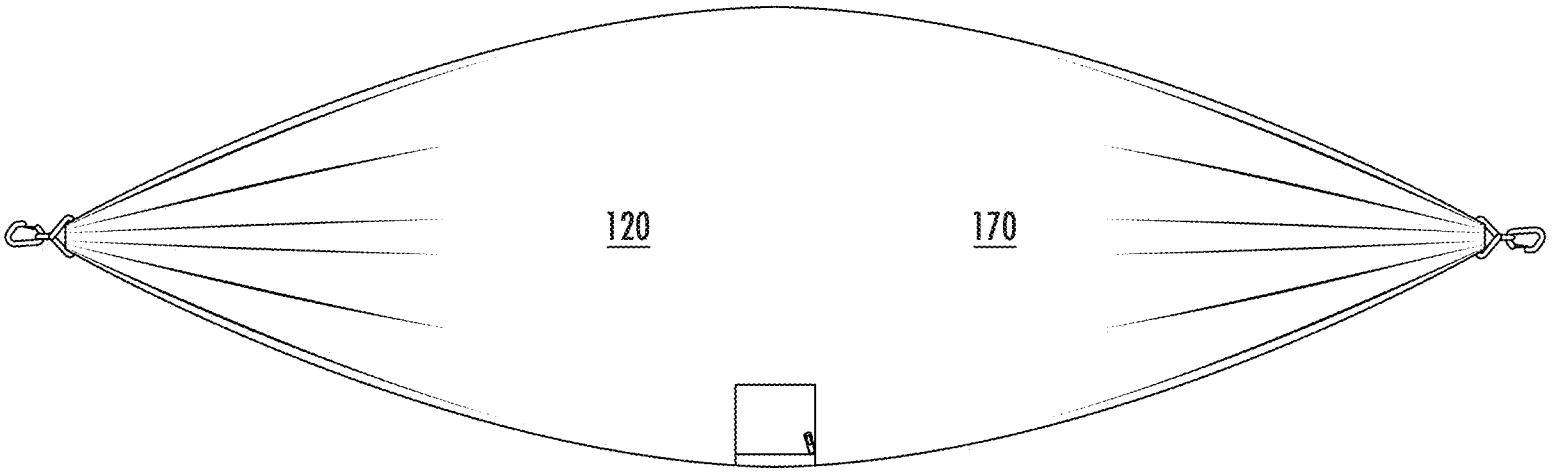
FIG. 21 illustrates a top plan view of the hammock support sheet of the FIG. 16 embodiment, when the hammock support sheet has been cinched.
Figure 23:
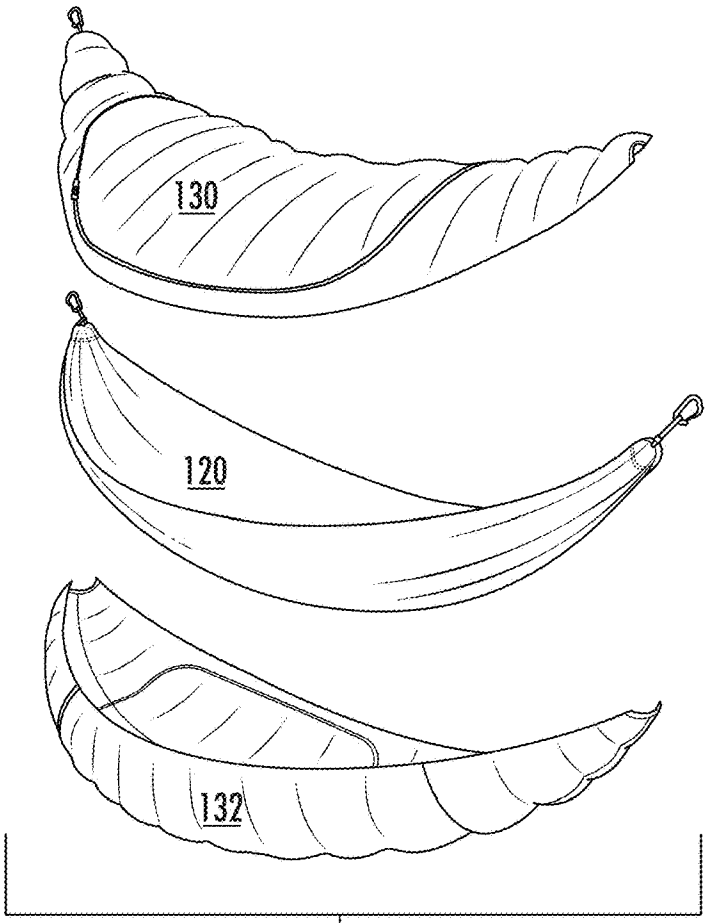
FIG. 23 illustrates a perspective, exploded view, from the foot end, of the embodiment of FIG. 16.
Figure 22:
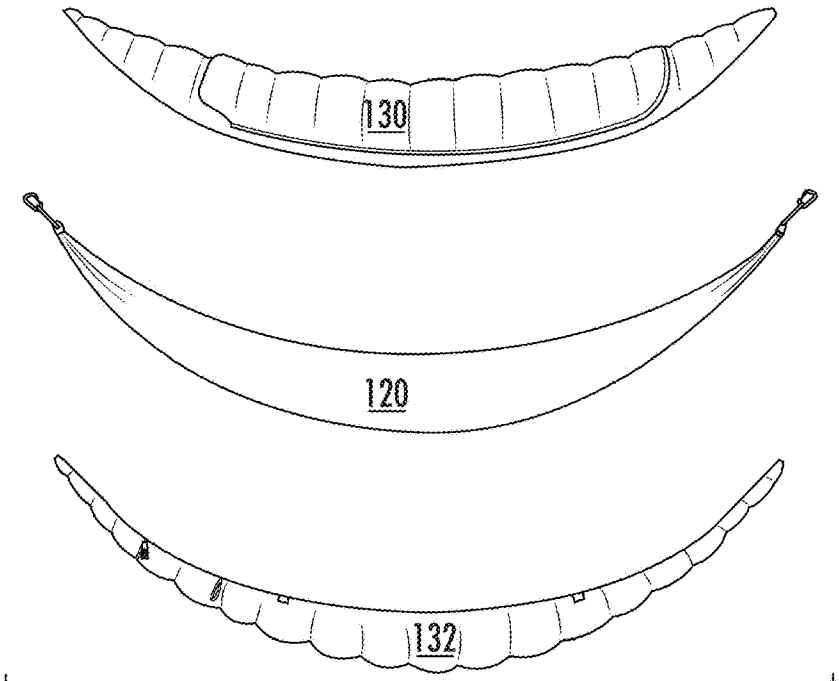
FIG. 22 illustrates a side, exploded view of the embodiment of FIG. 16.

With reference to FIGS. 20-21, further details regarding the construction and configuration of the strapless embodiment of the hammock support sheet 120 are illustrated. The hammock support sheet 120 includes, at both the head end 112 and the foot end 114, an amount of fabric that is folded back upon itself, and stitched down with a reinforce stitching pattern 180, to form paired tunnel loops 182, 184. These paired tunnel loops 182, 184 serve the purpose of supporting the weight of the hammock support sheet 120, when the head hang loop 122 and the foot hang loop 124 are run through the paired tunnel loops 182, 184. The hammock support sheet 120 also preferably includes one or more pockets 186 for use by a user when the hammock sleeping bag is in use and fully closed.

With reference to FIGS. 22-24C, further details of the configuration of certain embodiments of the hammock sleeping bag 120 are illustrated. As shown in FIGS. 24B & C, by implementing the top blanket zipper closure offset 162, and the bottom blanket zipper closure offset 180, the top blanket 130, the hammock support sheet 120, and the bottom blanket 132 can be stitched and bound together on the edges of the hammock support sheet 120, as shown in seam detail FIG. 24C. This serves to increase the strength and durability of the hammock sleeping bag, and simplifies implementation of the air gap configuration.

Figure 25:
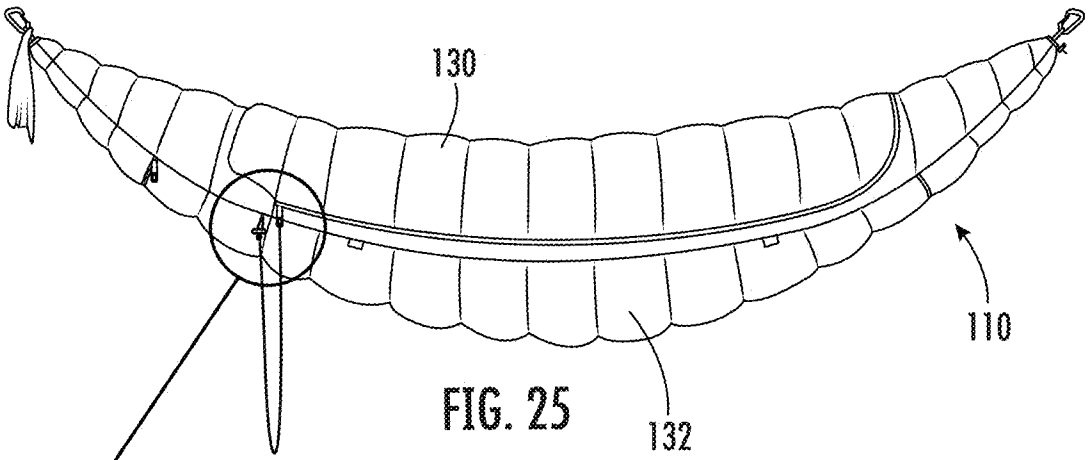
FIG. 25 illustrates the side view of the FIG. 16 embodiment.
Figure 25B:
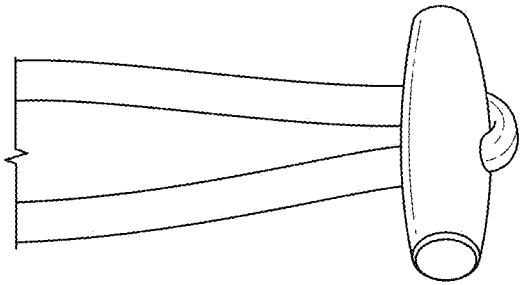
FIG. 25B is an enlarged illustration of one embodiment of the top blanket zipper closure pull cord grip.
Figure 25A:
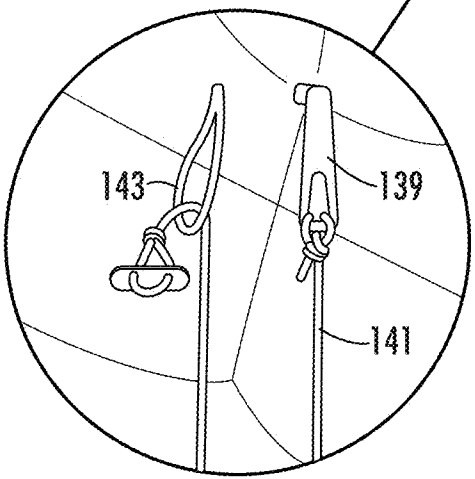
FIG. 25A is an enlarged call-out detail from FIG. 25, to further illustrate details of the top quilt zipper closure, cord, and attachment point.

With reference to FIGS. 25-25B, further details are provided regarding a preferred embodiment of the top blanket zipper closure 138, the top blanket zipper closure pull cord 141, and the top blanket zipper closure pull cord attachment point 143.

Figure 26D:
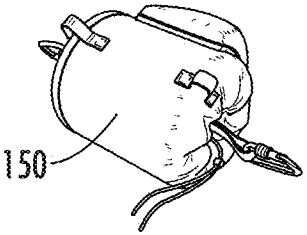
FIGS. 26A-E illustrate different views of the stuff sack of the FIG. 16 embodiment, including a front view (FIG. 26A), a back view (FIG. 26B), a top view (FIG. 26C), a perspective view (FIG. 26D), and a close-up perspective view of the top end hang strap protruding through the top end aperture (FIG. 26E).
Figure 26E:
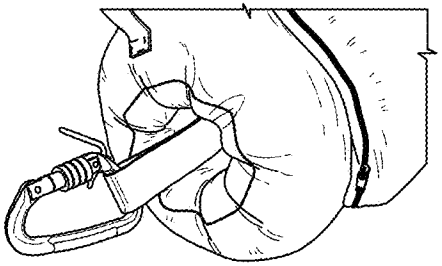
Figure 26C:
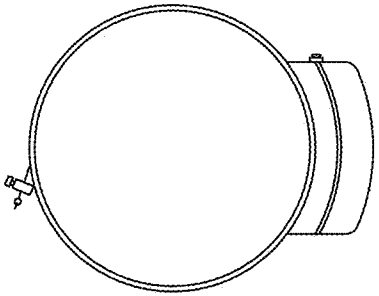
Figure 26A:
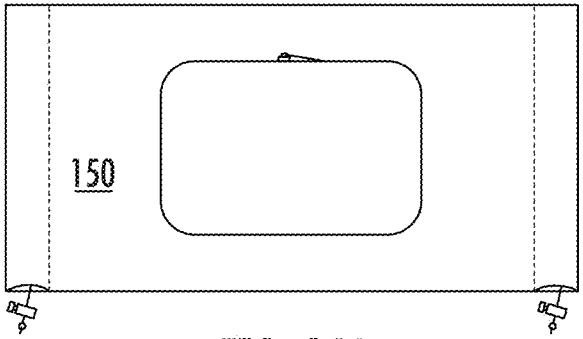
Figure 26B:
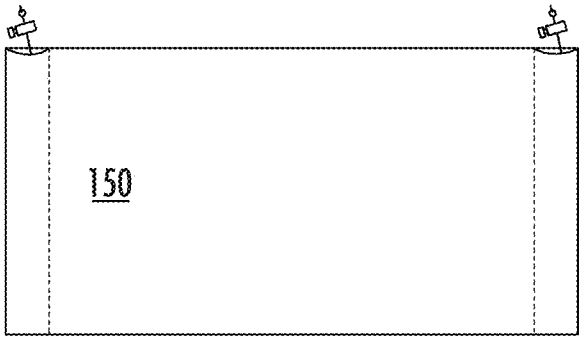

With reference to FIGS. 26A-E, further details are provided regarding a preferred embodiment of the quick deploy stuff sack. Exemplary dimensions are shown, but may be altered, depending on need. As shown in FIGS. 26D-E, the hammock sleeping bag may be stuffed into the quick deploy stuff sack 150 from either direction, and enables the head hang loop 122 and the foot hang loop 124 to extend from the apertures of the quick deploy stuff sack 150.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments disclosed.

Insofar as the description above discloses any additional subject matter that is not within the scope of the claims below, the inventions are not dedicated to the public and the right to file one or more applications to claim such additional inventions is reserved.

What is claimed is:

1. A hammock sleeping bag comprising:

a hammock support sheet having a head end, a foot end, a first edge, a second edge, and a transverse mid-point line from the first edge to the second edge at the approximate mid-point between the head end and the foot end;

a head hang strap affixed to the head end;

a foot hang strap affixed to the foot end;

wherein the head hang strap and the foot hang strap are configured to enable the hammock support sheet to be suspended between two points;

a top quilt affixed to the first edge;

a bottom quilt affixed to the second edge;

wherein the hammock support sheet, the top quilt, and the bottom quilt are integral to the hammock sleeping bag;

a first closeable zipper enabling a removable closure of the top quilt to the second edge of the support sheet;

a second closeable zipper enabling a removable closure of the bottom quilt to the first edge of the support sheet;

wherein the hammock support sheet has a first measured area and the bottom quilt has a second measured area;

wherein the bottom quilt has a centerline running from the head end to the foot end;

wherein the second measured area is larger than the second measured area, whereby, when the hammock support sheet is suspended between two points, and the second closeable zipper is closed, the bottom quilt centerline does not contact the hammock support sheet at the transverse mid-point line, thereby creating an air gap between the hammock support sheet and the bottom quilt; and wherein, when the hammock sleeping bag is in use, the bottom quilt along the centerline is not load-bearing at the air gap.

2. The hammock sleeping bag of claim 1 further comprising:

a first support strap extending from the head end to the foot end;

wherein the first support strap is affixed to the first edge of the hammock support sheet;

wherein the first support strap is affixed to the head hang strap at the head end;

wherein the first support strap is affixed to the foot hang strap at the foot end;

a second support strap extending from the head end to the foot end, wherein the second support strap is affixed to the second edge of the hammock support sheet;

wherein the second support strap is affixed to the head hang strap at the head end; and wherein the second support strap is affixed to the foot hang strap at the foot end.

3. The hammock sleeping bag of claim 1 wherein the hammock support sheet and the bottom quilt are configured such that the second area is sufficiently greater than the first area, such that the bottom quilt along the majority of the centerline is not load-bearing.

4. The hammock sleeping bag of claim 3 wherein the hammock support sheet and the bottom quilt are configured such that the second area is sufficiently greater than the first area, such that the bottom quilt along the entire centerline is not load-bearing.

5. The hammock sleeping bag of claim 1 wherein the air gap is at least 5 cm.

6. The hammock sleeping bag of claim 1 wherein the air gap is between 5 cm and 10 cm.

7. The hammock sleeping bag of claim 1 wherein the bottom quilt further comprises a first section and a second section, and the first section and the second section are affixed by a center seam positioned generally along the centerline.

8. The hammock sleeping bag of claim 1 wherein the bottom quilt comprises a box baffle quilt.

9. The hammock sleeping bag of claim 1 further comprising:

a first top quilt rollup closure affixed to the first edge;

wherein the top quilt may be unzipped from the second edge and rolled toward the first edge;

wherein the first top quilt rollup closure is configured to secure the rolled top quilt generally to the first edge.

10. The hammock sleeping bag of claim 9 further comprising:

a second top quilt rollup closure affixed to the first edge;

wherein the top quilt may be unzipped from the second edge and rolled toward the first edge;

wherein the second top quilt rollup closure is configured to secure the rolled top quilt generally to the first edge.

11. The hammock sleeping bag of claim 1 further comprising:

a first bottom quilt rollup closure affixed to the second edge;

wherein the bottom quilt may be unzipped from the first edge and rolled toward the second edge;

wherein the first bottom quilt rollup closure is configured to secure the rolled bottom quilt generally to the second edge.

12. The hammock sleeping bag of claim 11 further comprising:

a second bottom quilt rollup closure affixed to the second edge;

wherein the bottom quilt may be unzipped from the first edge and rolled toward the second edge;

wherein the second bottom quilt rollup closure is configured to secure the rolled bottom quilt generally to the second edge.

13. The hammock sleeping bag of claim 1 further comprising:

a top quilt zipper pull cord attached to a first zipper pull tab of a first zipper slider, of the first closeable zipper;

a top quilt zipper pull cord attachment point located proximal to a top stop of the first closeable zipper;

wherein the top quilt zipper pull cord is attached to the top quilt zipper pull cord attachment point;

wherein the top quilt zipper pull cord is of a sufficient length to enable the first zipper slider to run the entire length of the first closeable zipper;

whereby a user in the hammock sleeping bag may use the top quilt zipper pull cord to pull the first zipper slider the entire length of the first closeable zipper so as to close the first closeable zipper without touching the first zipper pull tab.

14. The hammock sleeping bag of claim 1 further comprising:

wherein the top quilt further comprises a top quilt face overlap, proximal to the head end;

wherein the top quilt face overlap comprises an overlap of the top quilt at the approximate position of the face of a user when in use;

wherein the top quilt face overlap may be folded into an open position to allow for the user's face to be exposed when in use;

wherein the top quilt face overlap may be flipped up into a closed position to cover the user's face when in use;

wherein the top quilt face overlap includes at least one plastic snap to removably secure the top quilt face overlap into the closed position.

15. The hammock sleeping bag of claim 1 wherein there are no transverse support straps on the hammock support sheet.

16. The hammock sleeping bag of claim 1 comprising:

wherein the first zipper closure is inwardly offset from the first edge by a first edge offset distance;

wherein the second zipper closure is inwardly offset from the second edge by a second edge offset distance;

wherein the top quilt, the hammock support sheet, and the bottom quilt are stitched together at a single seam along the first edge; and wherein the top quilt, the hammock support sheet, and the bottom quilt are stitched together at a single seam along the second edge.

17. The hammock sleeping bag of claim 16 wherein the first edge offset distance is 5 centimeters and the second edge offset distance is 5 centimeters.

18. The hammock sleeping bag of claim 1 further comprising:

a stuff sack configured to fit the top quilt, hammock support sheet, and bottom quilt, when in a compressed condition;

wherein the stuff sack is affixed to and integral to the hammock sleeping bag.

19. The hammock sleeping bag of claim 18 comprising:

wherein the stuff sack further comprises a head end aperture and a foot end aperture;

wherein when the hammock sleeping bag is in a compressed position inside the stuff sack, the head end hang strap may extend through the head end aperture and the foot end hang strap may extend through the foot end aperture;

such that when a user desires to deploy the hammock sleeping bag, the user may pull the head end strap and the head end strap and the hammock sleeping bag will exit the stuff sack and through the head end aperture.

20. The hammock sleeping bag of claim 1 further comprising:

a top quilt draft tube affixed to the first zipper closure, such that when the first zipper closure is closed, the top quilt draft tube is inside of the top quilt and positioned such that the top quilt draft tube will reduce drafts passing through the first zipper closure.

21. The hammock sleeping bag of claim 1 further comprising an insulated foot pocket.

22. The hammock sleeping bag of claim 1 further comprising a removable rain fly.

23. The hammock sleeping bag of claim 22 wherein the rain fly has an integrated lightweight LED strip and an integrated battery, for providing illumination.

24. The hammock sleeping bag of claim 1 comprising:

wherein the head end of the hammock support sheet is folded upon itself, stitched, and gathered so as to create a head end hammock support sheet tunnel loop;

wherein the head end hang strap is inserted through the hammock support sheet tunnel loop;

wherein the foot end of the hammock support sheet is gathered, folded upon itself, and stitched, so as to create a foot end hammock support sheet tunnel loop; and wherein the foot end hang strap is inserted through the foot end hammock support sheet tunnel loop.

* * * * *